US007721713B2

(12) United States Patent
Hayatani et al.

(10) Patent No.: US 7,721,713 B2
(45) Date of Patent: May 25, 2010

(54) ELECTROMAGNETIC FUEL INJECTOR AND METHOD FOR ASSEMBLING THE SAME

(75) Inventors: Masahiko Hayatani, Hitachinaka (JP); Motoyuki Abe, Hitachinaka (JP); Atsushi Sekine, Hitachinaka (JP); Tohru Ishikawa, Kitaibaraki (JP)

(73) Assignee: Hitachi, Ltd., Tokyo (JP)

( * ) Notice: Subject to any disclaimer, the term of this patent is extended or adjusted under 35 U.S.C. 154(b) by 586 days.

(21) Appl. No.: 11/654,520

(22) Filed: Jan. 18, 2007

(65) Prior Publication Data

US 2007/0194151 A1 Aug. 23, 2007

(30) Foreign Application Priority Data

Feb. 17, 2006 (JP) ..... 2006-040930

(51) Int. Cl.
*F02M 59/46* (2006.01)

(52) U.S. Cl. ..... 123/467

(58) Field of Classification Search ..... 239/585.1, 239/533.2; 251/337, 129.19, 129.21, 139, 251/129.03; 123/467, 299, 506, 445, 446, 123/510

See application file for complete search history.

(56) References Cited

U.S. PATENT DOCUMENTS

| | | | | |
|---|---|---|---|---|
| 4,385,339 | A * | 5/1983 | Takada et al. | 361/154 |
| 4,679,017 | A * | 7/1987 | Mishler et al. | 335/164 |
| 4,749,892 | A | 6/1988 | Mesenich | |
| 5,299,776 | A * | 4/1994 | Brinn et al. | 251/77 |
| 6,170,767 | B1 | 1/2001 | Herold et al. | |
| 6,367,769 | B1 * | 4/2002 | Reiter | 251/129.19 |
| 6,520,434 | B1 | 2/2003 | Reiter | |
| 6,808,134 | B2 * | 10/2004 | Noller et al. | 239/585.1 |
| 6,932,283 | B2 | 8/2005 | Stier | |
| 2002/0043575 | A1 | 4/2002 | Sekine et al. | |
| 2003/0160117 | A1 | 8/2003 | Stier | |

FOREIGN PATENT DOCUMENTS

| | | | |
|---|---|---|---|
| DE | 197 56 103 | A1 | 6/1999 |
| DE | 199 27 900 | A1 | 12/2000 |
| EP | 1 262 655 | A2 | 5/2002 |
| EP | 1 550 804 | A1 | 7/2005 |
| JP | 2002-130071 | A | 5/2002 |
| JP | 3734702 | B2 | 10/2005 |
| WO | WO 2004/074673 | A1 | 9/2004 |

OTHER PUBLICATIONS

European Search Report dated Apr. 11, 2007(six (6) pages).

* cited by examiner

*Primary Examiner*—Stephen K Cronin
*Assistant Examiner*—Keith Coleman
(74) *Attorney, Agent, or Firm*—Crowell & Moring LLP

(57) ABSTRACT

An electromagnetic fuel injection valve comprising: a metallic cylindrical-shaped vessel provided at a tip end thereof with a fuel injection port, the other end thereof being closed by a stationary core provided centrally thereof with a through-hole; a movable member arranged between the stationary core and the fuel injection port and provided at a tip end thereof with a valve element, which opens and closes the fuel injection port, a maximum outside diameter of the movable member being smaller than a minimum inside diameter of the through-hole; and an electromagnetic drive mechanism that reciprocates the movable member.

35 Claims, 12 Drawing Sheets

ELECTROMAGNETIC FUEL INJECTOR AND METHOD FOR ASSEMBLING THE SAME

BACKGROUND OF THE INVENTION

The present invention relates to an electromagnetically drive type fuel injection valve for internal combustion engines and a method of assembling the same, and more particularly, to an electromagnetic fuel injection valve, in which a stationary core and a movable member are arranged in a cylindrical-shaped vessel made of a metallic material, an electromagnetic drive device drives the movable member, and a valve element provided at a tip end of the movable member opens and closes a fuel injection port provided at a tip end of the cylindrical-shaped vessel made of a metallic material, and a method of assembling the same.

An electromagnetic fuel injection valve of this type comprises a cylindrical-shaped metallic vessel, in which a fuel injection port means is fitted to a tip end side thereof.

A stationary core formed centrally thereof with a through-hole, which makes a fuel introduction passage, is fitted to an inner periphery of the metallic cylindrical-shaped vessel on a rear end side thereof.

A movable member is arranged between a stationary core and the fuel injection port.

The movable member comprises a plunger and an anchor provided on an end of the plunger on the stationary core side so as to face an end surface of the stationary core.

Also, a valve element to open and close the fuel injection port is provided on the other end of the plunger.

A cylindrical-shaped electromagnetic coil device is mounted to an outer periphery of the metallic cylindrical-shaped vessel and a magnetic path passing through the stationary core and the anchor is formed around the electromagnetic coil device.

The stationary core is mounted to the metallic cylindrical-shaped vessel which is lengthy in an axial direction after the movable member is assembled, and then a spring for biasing the movable member in a direction, in which the valve element of the movable member closes the fuel injection port, and a regulator for regulating the bias of the spring are arranged in this order in the fuel introduction passage of the stationary core.

With a conventional electromagnetic fuel injection valve and a method of assembling the same, for example disclosed in Japanese Patent No. 3734702, a movable member is first assembled into a metallic cylindrical-shaped vessel and then a stationary core is fixed to an inner periphery of an open end of the metallic cylindrical-shaped vessel.

Therefore, there is caused a problem that it is difficult to regulate the movable member in stroke.

It is an object of the invention to provide an electromagnetic fuel injection valve, in which it is easy to regulate a movable member in stroke, and a method of assembling the same.

SUMMARY OF THE INVENTION

The object of the invention is attained by making a maximum outside diameter of a movable member, which is arranged between a stationary core and a fuel injection port and includes at a tip end thereof a valve element to open and close the fuel injection port, smaller than a minimum inside diameter of a through-hole provided centrally of the stationary core.

Also, the object is attained by fixing the stationary core to an inner periphery of a rear end of a metallic cylindrical-shaped vessel and has a fuel injection port at a tip end thereof, and then mounting a movable member, which includes at a tip end thereof a valve element to open and close the fuel injection port, through the through-hole of the stationary core.

According to the invention constructed in this manner, the movable member is assembled after the stationary core is fixed, so that it is easy to regulate the movable member in stroke.

Other objects, features and advantages of the invention will become apparent from the following description of the embodiments of the invention taken in conjunction with the accompanying drawings.

DESCRIPTION OF THE PREFERRED EMBODIMENTS OF THE INVENTION

An embodiment of the invention will be described below in detail with reference to the drawings.

First Embodiment

The present embodiment is one in which the invention is applied to a fuel injection valve for internal combustion engines comprising an electromagnetic coil.

By energizing or deenergizing the electromagnetic coil, an anchor is attracted to a stationary core, or separated from the stationary core. At this time, a movable member provided at a tip end thereof with a valve element is reciprocated by movements of the anchor.

A fuel injection port provided at a tip end of a nozzle portion is opened and closed by the reciprocation of the movable member, and a fuel is injected from the fuel injection port.

Specifically, the invention is embodied in an electromagnetic fuel injection valve of a type, that is, a so-called long-type electromagnetic fuel injection valve, in which an extent from a fuel introduction port at an end to a fuel injection port at the other end is lengthy in dimension and a movable member is consequently long.

Figure 1:
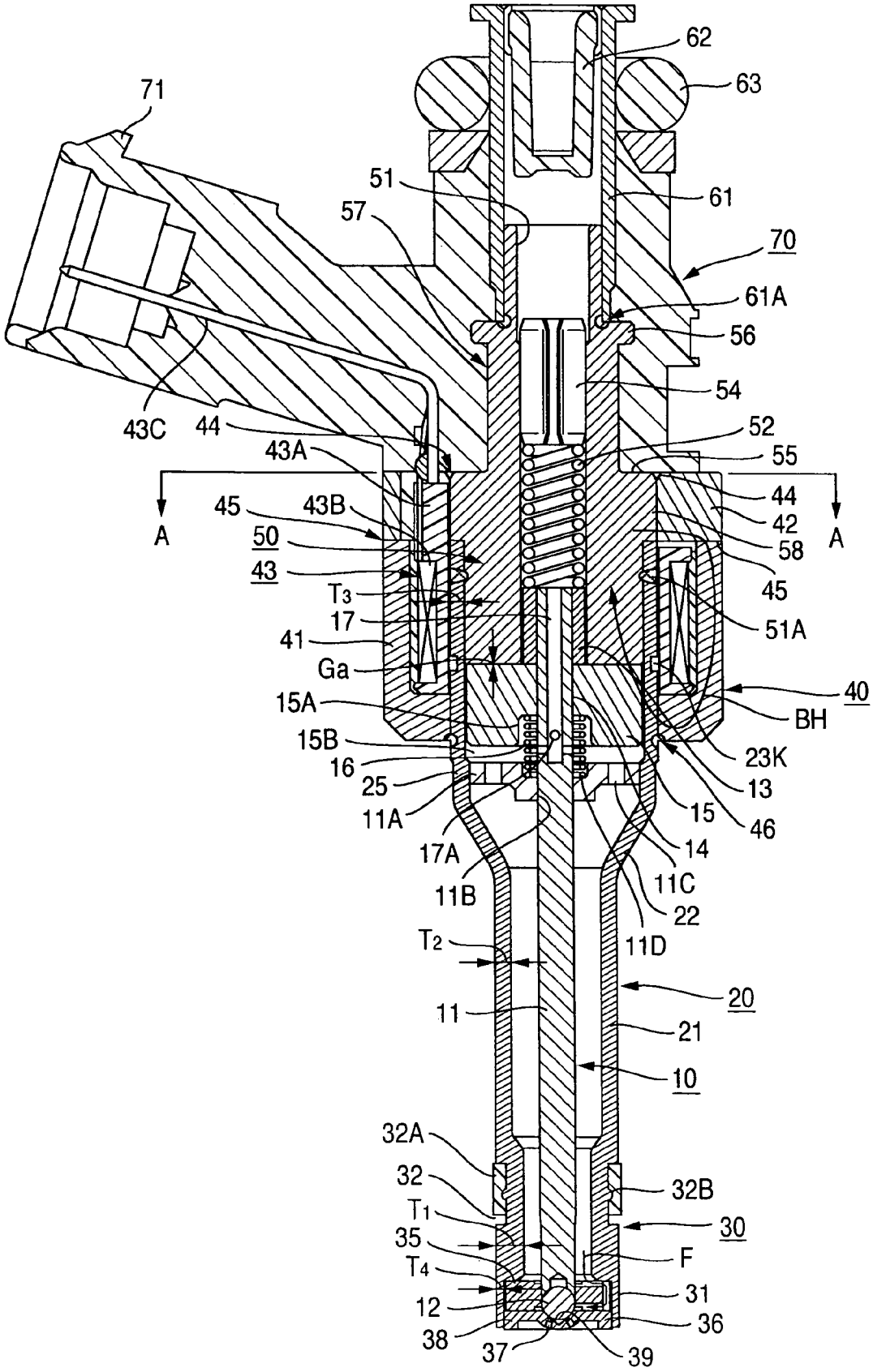
FIG. 1 is a longitudinal, cross sectional view showing an electromagnetic fuel injection valve according to a first embodiment.
Figure 2:
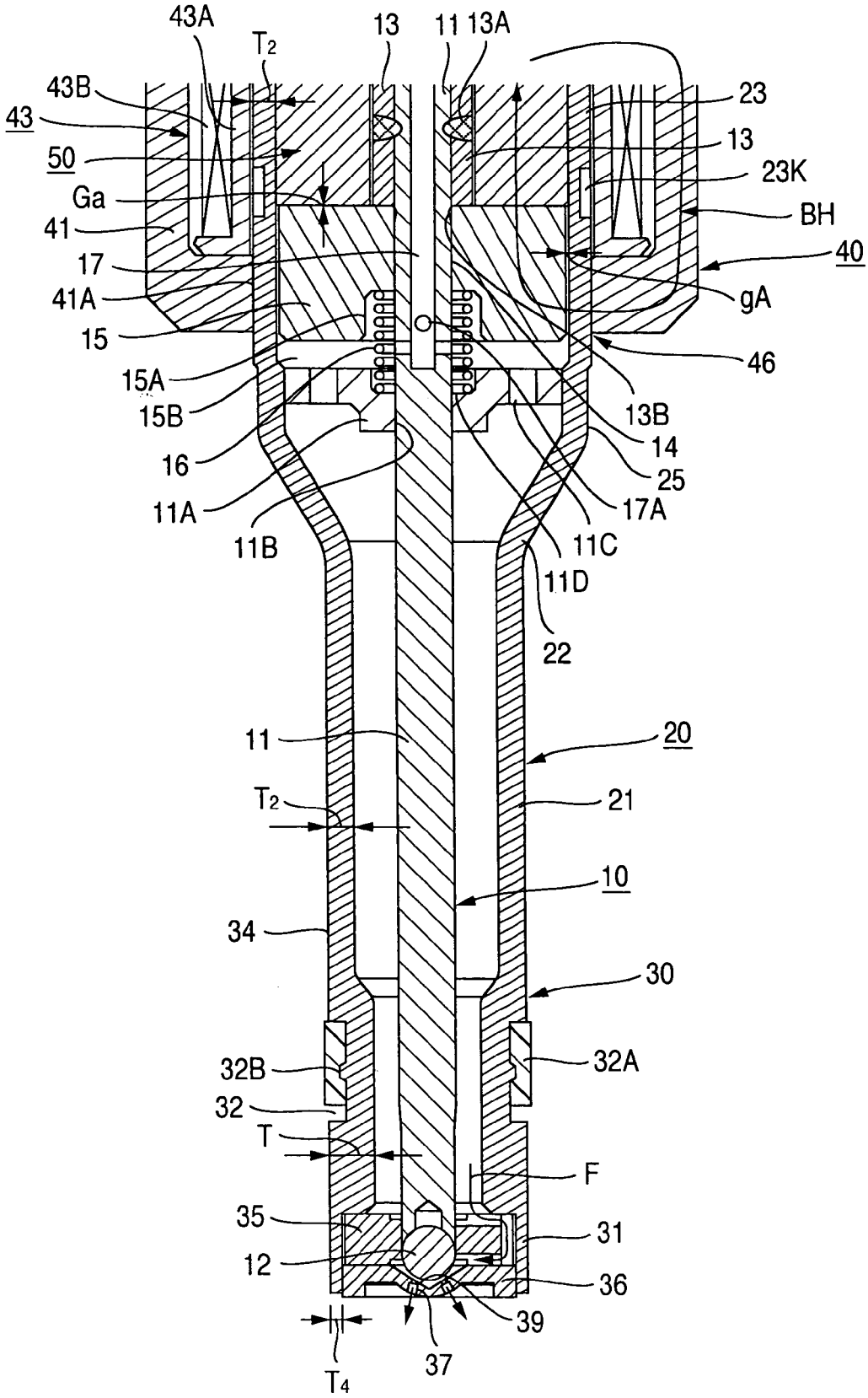
FIG. 2 is a partially enlarged, cross sectional view showing the electromagnetic fuel injection valve according to the first embodiment.
Figure 3:
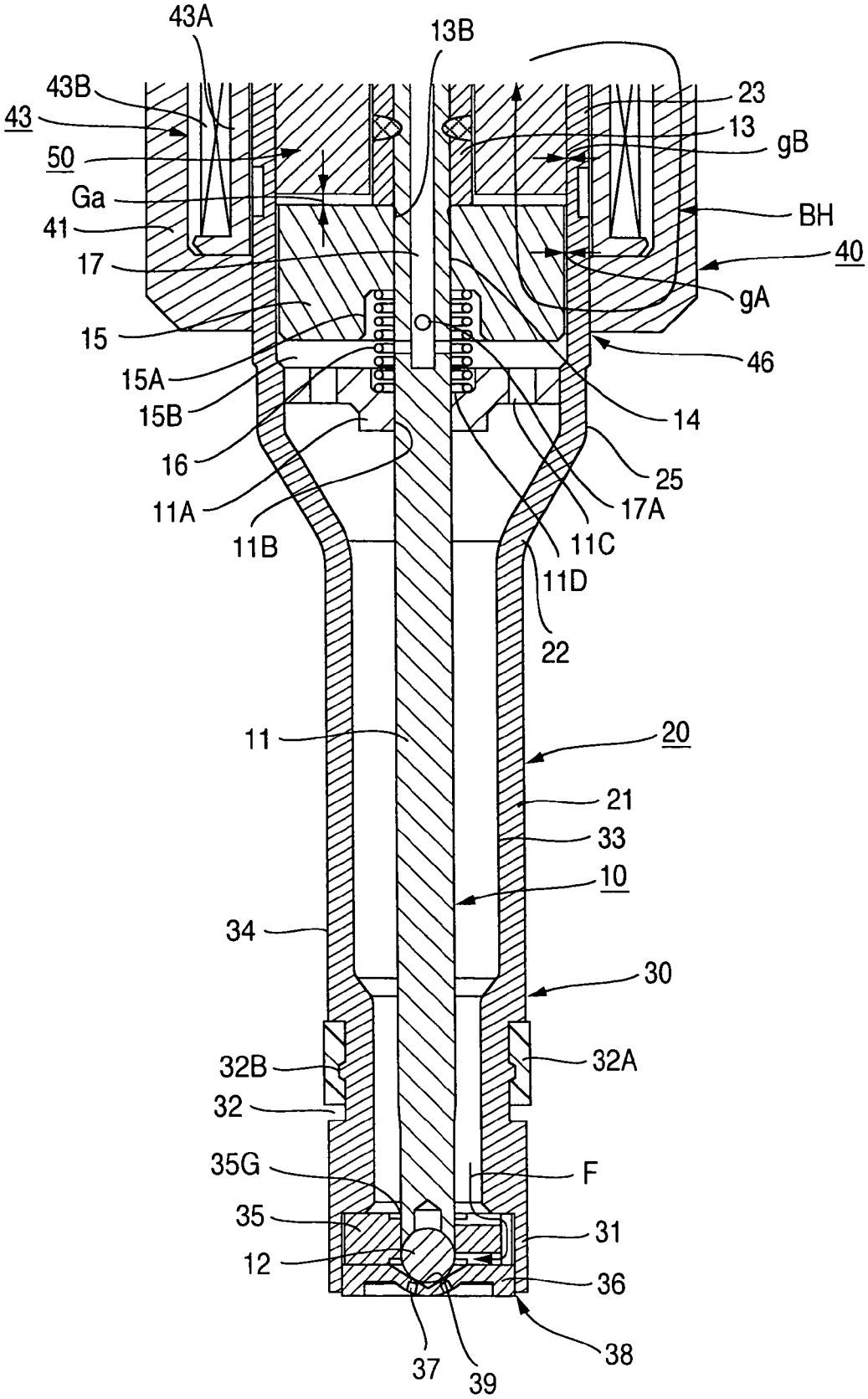
FIG. 3 is a partially enlarged, cross sectional view showing the electromagnetic fuel injection valve according to the first embodiment.

FIG. 1 is a longitudinal, cross sectional view showing an electromagnetic fuel injection valve according to an embodiment. FIGS. 2 and 3 are views, in which FIG. 1 is partially enlarged, illustrating an operating state of the electromagnetic fuel injection valve according to the embodiment, FIG. 2 is a view showing a valve opened state, and FIG. 3 is a view showing a valve closed state.

A whole construction of the electromagnetic fuel injection valve according to the embodiment will be described below with reference to FIGS. 1 to 3.

A metallic cylindrical-shaped vessel 20 comprises a small-diameter cylindrical-shaped portion 21 having a small diameter and a large-diameter cylindrical-shaped portion 23 having a large diameter, and the both portions are connected together by a conical section portion 22.

A nozzle body 30 is formed on a tip portion of the small-diameter cylindrical-shaped portion 21.

A guide member 35 and an orifice plate 36 are laminated in this order to be inserted into a cylindrical-shaped portion 31 formed at the other end of the nozzle body 30, and fixed to the cylindrical-shaped portion 31 at a periphery 38 of the orifice plate 36 by means of welding.

The guide member 35 guides an outer periphery of a plunger 11 or a valve element 12 of a movable member 10 described later and serves as a fuel guide to guide a fuel inward from outward in a radial direction as indicated by an arrow F in the drawing. The orifice plate comprises a plurality of fuel injection ports 37 provided obliquely to a central axis of the plunger to extend therethrough. The plurality of through-holes are formed from stepped holes, which have different diameters and are small in diameter at inlet sides (toward the valve element) and large in diameter at outlet sides.

A conical-shaped valve seat 39 is formed on that side of the orifice plate 36, which faces the guide member 35. The valve element 12 provided at a tip end of the plunger 11 described later abuts against the valve seat 39 to lead or cut off flow of a fuel indicated by the arrow F.

The nozzle body 30 is formed to have a larger wall thickness $T_1$ than other wall thicknesses $T_2$ to $T_4$ of the metallic cylindrical-shaped vessel 20. This is because a groove 32 is formed on the outer periphery of the nozzle body and a sealing member 32A typified by a chip seal made of a resin material or a gasket having rubber baked around a metallic material is fitted into the groove 32.

An annular-shaped small projection 32B is provided centrally of the groove 32 to thereby restrict movement of the sealing member 32A in a thrust direction, thus effecting coming-off prevent function when the fuel injection valve is mounted to a mount hole on a cylinder head or a cylinder block of an engine.

After the sealing member 32A is mounted, a sealed portion becomes larger in outside diameter than the nozzle body 30 and thus the sealing member 32A comes into pressure contact with an inner wall of the mount hole on the cylinder head or the cylinder block. Thus the sealing function is achieved in a state, in which high pressure in a combustion chamber acts.

On the other hand, an outside diameter of the nozzle body 30 and an outside diameter of the small-diameter cylindrical-shaped portion 21 of the metallic cylindrical-shaped vessel 20 are slightly smaller than a diameter of the mount hole on the cylinder head or the cylinder block, so that they are fitted into the mount hole in a clearance fit state.

An inside diameter of the nozzle body 30 is maintained in a uniform, small diameter up to a position, in which the cylindrical-shaped portion 31 begins, to define a fuel passage having a constant cross sectional area on an outer periphery of the plunger 11 of the movable member 10.

An inside diameter of the nozzle body 30 is increased about the cylindrical-shaped portion 31 to define a region, into which the guide member 35 and the orifice plate 36 are inserted.

An outside diameter of the cylindrical-shaped portion 31 of the nozzle body 30 is made uniform up to a tip end thereof, the wall thickness $T_4$ is thinner than the remaining wall thicknesses $T_1$ to $T_3$, and the cylindrical-shaped portion is formed at the foremost tip end of the nozzle body 30 to mount thereto the guide member 35 and the orifice plate 36.

A plunger guide 11A, which guides the plunger 11 of the movable member 10, is press fitted and fixed to a drawn portion 25 at a lower end of an inner periphery of the large-diameter cylindrical-shaped portion 23 of the cylindrical-shaped vessel 20.

The plunger guide 11A is provided centrally thereof with a guide hole 11B, through which the plunger 11 is guided and around which are formed a plurality of fuel passages 11C.

Further, a recess 11D is formed on an upper surface centrally of the plunger guide by means of extrusion. A spring described later is held in the recess 11D.

A projection corresponding to the recess 11D is formed on a central, lower surface of the plunger guide 11A and the guide hole 11B for the plunger 11 is provided centrally of the projection.

Thus the lengthy-shaped plunger 11 is guided by the guide hole 11B of the plunger guide 11A and the guide hole of the guide member 35 to reciprocate straight.

In this manner, since the same member integrally forms a forward end of the metallic cylindrical-shaped vessel 20 as far as a rear end thereof, parts control is easy to exercise and assembly is good in workability.

The movable member 10 comprises the lengthy plunger 11. The valve element 12 is fixed to one end of the plunger 11 by means of welding. The plunger is formed at a tip end thereof with a recess, and a part of an outer periphery of a ball valve is fitted into the recess to be welded at contact portions of the both elements.

A cylindrical-shaped head 13 having a larger outside diameter than a diameter of the plunger 11 is fitted onto the other end of the plunger to be welded at 13A on an outer periphery of the portion thus fitted.

Such weld may be such that an upper end surface of the plunger 11 is welded annularly in a region in contact with the head 13. In this case, it is required that a surface, on which a first spring 52 described later is seated, be not made irregular by a weld, or an inside diameter of the spring be made larger than a diameter of a weld.

Also, an inner periphery of a lower end surface of the head 13 may be welded annularly in a region in contact with the plunger 11. In this case, it is preferred that in order to eliminate interference between an upper end surface of an anchor 15 described later and a weld, an annular recess be provided on an inner periphery of the head 13 or an outer periphery of the plunger 11, which forms a weld, so as to form contact portions of the both elements in a dent of the annular recess to perform welding in the dent of the annular recess, or an annular recess be provided on an inner periphery of the upper end surface of the anchor 15 to accommodate irregularities of an annular weld.

The movable member 10 comprises the anchor 15 provided centrally thereof with a through-hole 14, through which the plunger 11 extends. A spring-bearing recess 15A is formed centrally of a surface of the anchor 15 on a side facing the plunger guide 11A and a spring 16 is held between the recess 11D of the plunger guide 11A and the recess 15A.

Since the through-hole 14 is smaller in diameter than the cylindrical-shaped head 13, a lower end surface of the head 13 of the plunger 11 abuts against and engages with the upper end surface of the anchor 15 held by the spring 16 (second spring) under the action of a bias of the spring 52 (first spring), with which the plunger 11 is pushed toward the valve seat 39 of the orifice plate 36, or the gravitational force.

Thereby, in upward movement of the anchor 15 against the bias of the spring 52 (first spring) or the gravitational force and in downward movement of the plunger 11 by the bias of the spring 52 or the gravitational force, the both elements cooperate with each other to move together.

However, when a force tending to move the plunger 11 upward irrespective of the bias of the spring 52 or the gravitational force, or a force tending to move the anchor 15 downward acts on the both elements independently and separately, the both elements are trying to move in different directions.

At this time, a film of a fluid present in a minute gap of 5 to 15 microns between an outer peripheral surface of the plunger 11 and an inner peripheral surface of the anchor 15 in the through-hole 14 generates friction to movements of the both elements in different directions to suppress movements of the both elements. That is, braking is effected on rapid displacements of the both elements. Little resistance is provided to slow movements. Thus such momentary motions of the both elements in opposite directions damp in a short period of time.

An explanation will be given hereinbelow to an effect based on this phenomenon.

Here, a central position of the anchor 15 is held not between an inner peripheral surface of the large-diameter cylindrical-shaped portion 23 and an outer peripheral surface of the anchor 15 but by an inner peripheral surface of the through-hole 14 of the anchor 15 and the outer peripheral surface of the plunger 11. The outer peripheral surface of the plunger 11 functions as a guide when the anchor 15 moves singly in an axial direction.

A lower end surface of the anchor 15 faces an upper end surface of the plunger guide 11A but the both elements do not come into contact with each other since the spring 16 is interposed therebetween.

While the plunger 11 of the movable member 10 is wholly made of a solid metal, a hole 17 as a fuel passage is formed centrally of the plunger to extend to a position about the plunger guide 11A from an upper end thereof, to which the cylindrical-shaped head 13 is fixed, and communicated to a fuel passage 15B around the outer periphery of the plunger 11 through a plurality of radial, transverse holes 17A positioned on the recess 15A of the anchor 15 for the spring 16.

A minute air gap gA is provided between an outer peripheral surface of the anchor 15 and the inner peripheral surface of the large-diameter cylindrical-shaped portion 23 of the metallic cylindrical-shaped vessel 20. The minute air gap gA amounts to around, for example, 0.1 millimeter to be larger than a minute gap of 5 to 15 microns formed between the outer peripheral surface of the plunger 11 and the inner peripheral surface of the anchor 15. Since a large magnetoresistance results when the minute air gap becomes excessively large, the gap is determined in association with magnetoresistance.

A stationary core 50 is press fitted into the inner peripheral of the large-diameter cylindrical-shaped portion 23 of the metallic cylindrical-shaped vessel 20 to be joined at a weld 51A in a position of press fit and contact. Such weld joining seals a gap, which is formed between an interior of the large-diameter cylindrical-shaped portion 23 of the metallic cylindrical-shaped vessel 20 and an outside air and through which a fuel passes between the inner peripheral surface of the large-diameter cylindrical-shaped portion 23 of the metallic cylindrical-shaped vessel 20 and an outer peripheral surface of the stationary core 50 to leak.

An annular flange 58 is formed on an outer periphery of the stationary core 50 and an upper end surface of the large-diameter cylindrical-shaped portion 23 of the metallic cylindrical-shaped vessel 20 abuts against a lower end surface of the flange 58, so that the both elements are positioned.

An A-A plane, on which an upper end surface (shoulder 55 of the stationary core 50) of the flange 58 is positioned, and an upper end surface of an annular yoke 42 are held in a manner to be positioned on the same plane, and welding is made annularly along a contact portion 44 of the annular yoke 42 and the stationary core 50.

The stationary core 50 is formed centrally thereof with a through-hole 51, which is slightly larger in diameter than the head 13 of the plunger 11.

The cylindrical-shaped head 13 of the plunger 11 is inserted through an inner periphery of a lower end of the through-hole 51 of the stationary core 50 in a non-contact state. A gap between an inner peripheral surface of the through-hole 51 of the stationary core 50 and an outer periphery of the head 13 of the movable member 10 is in the same order as the minute air gap gA. This is intended to eliminate a surplus resistance to reciprocation of the movable member 10.

An end of an initial load setting spring 52 (second spring) abuts against an upper end surface of the head 13 of the plunger 11 and the other end thereof is born by a regulator 54 press fitted into an upper end of the through-hole 51 whereby the spring is fixed between the cylindrical-shaped head 13 and the regulator 54.

An initial load, with which the spring 52 pushes the plunger 11 against the valve seat 39, can be regulated by regulating a position, in which the regulator 54 is fixed.

As shown in FIGS. 2 and 3, in a state, in which an initial load of the initial load setting spring 52 is regulated, a lower end surface of the stationary core 50 faces the upper end surface of the anchor 15 of the movable member 10 with a magnetic gap Ga of around 20 to 100 microns (exaggerated in the drawings) therebetween.

An outside diameter of the anchor 15 is slightly smaller (about 0.1 millimeter) than an outside diameter of the stationary core 50. On the other hand, an inside diameter of the through-hole 14 positioned centrally of the anchor 15 is slightly larger than outside diameters of the plunger 11 of the movable member 10 and the valve element 12. Also, an inside diameter of the through-hole 51 of the stationary core 50 is slightly larger than an outside diameter of the cylindrical-shaped head 13. The outside diameter of the head 13 is larger than the inside diameter of the through-hole 14.

Consequently, an annular end surface of the anchor 15 facing the stationary core with the magnetic gap Ga therebetween is larger in width in a radial direction than an annular end surface of the stationary core 50. Thereby, while a magnetic path area on the magnetic gap Ga is ensured adequately, a margin of engagement in an axial direction is ensured between the lower end surface of the head 13 of the movable member 10 and the upper end surface of the anchor 15 of the movable member 10.

In addition, a groove 13B is provided on the outer peripheral surface of the plunger 11, which faces an edge at an upper end of an inner periphery of the anchor 15. Even when irregularities attributable to burr generated at the time of working are present on the edge at the upper end of the inner periphery of the anchor 15, the groove 13B takes account of preventing contact between the both elements so that relative movements of the both elements are not adversely affected.

Referring again to FIG. 1, a portion of the stationary core 50 projecting upward from the shoulder 55 is not needed to function as a magnetic path, so that it is made small in thickness in a radial direction. A flange 56 is formed in an intermediate position between the shoulder 55 and a tip end of that portion, which projects upward from the shoulder 55, and an annular groove 57 is formed between the shoulder 55 and the flange 56.

A portion projecting upward from the flange 56 is further made small in thickness in a radial direction. An inner peripheral surface of a lower end of a fuel introduction pipe 61 is press fitted outside the small-thickness portion to be welded to the stationary core 50 at an outer periphery 61A of the lower end of the fuel introduction pipe 61.

On the other hand, a fuel filter 62 and an O-ring 63 are respectively fitted an inner periphery and an outer periphery of the fuel introduction pipe 61.

A cup-shaped yoke 41 and the annular yoke 42 provided in a manner to close an opening on an open side of the cup-shaped yoke are fixed to an outer periphery of the large-diameter cylindrical-shaped portion 23 of the metallic cylindrical-shaped vessel 20.

A through-hole 41A is provided centrally of a bottom of the cup-shaped yoke 41 and the large-diameter cylindrical-shaped portion 23 of the metallic cylindrical-shaped vessel 20 is inserted through the through-hole 41A.

A peripheral wall portion of the cup-shaped yoke 41 faces an outer peripheral surface of the large-diameter cylindrical-shaped portion 23 of the metallic cylindrical-shaped vessel 20.

The flange 58 of the metallic cylindrical-shaped vessel 20 is formed to have an outer periphery being the same as an inside diameter of the annular yoke 42, and an inner periphery of the annular yoke 42 is press fitted onto the outer periphery of the flange 58 to be welded annularly to the same at a contact surface of an upper end surface thereof.

The annular yoke 42 and the cup-shaped yoke 41 are formed to be the same in outside diameter as each other.

The cup-shaped yoke 41 is positioned in a state, in which the upper end surface of the cup-shaped yoke 41 abuts against a lower end surface of the annular yoke 42.

A cylindrical-shaped electromagnetic coil 43 is arranged in a cylindrical-shaped space defined by the cup-shaped yoke 41 and the annular yoke 42.

The electromagnetic coil 43 comprises an annular coil bobbin 43A, of which a cross section opened radially outward has a U-shaped groove, and an annular coil 43B formed by a copper wire, which is wound in the groove.

An electromagnetic coil device 40 comprises the electromagnetic coil 43, the cup-shaped yoke 41, and the annular yoke 42.

The cup-shaped yoke 41 is fixed to the annular yoke 42 by performing welding annularly along a joined surface 45 of an outer peripheral edge of an upper end of the cup-shaped yoke 41 and an outer peripheral edge of a lower end of the annular yoke 42.

Also, the cup-shaped yoke 41 is fixed to the outer periphery of the large-diameter cylindrical-shaped portion 23 of the metallic cylindrical-shaped vessel 20 by performing welding annularly along a joined surface 46 of an inner peripheral edge of a lower end of the cup-shaped yoke 41 and the outer peripheral surface of the large-diameter cylindrical-shaped portion 23.

Thus a toroidal magnetic path BH indicated by an arrow BH is formed around the electromagnetic coil 43.

A conductor 43C having stiffness is fixed to a volute tongue and a volute tail of the electromagnetic coil 43 and the conductor 43C is taken out through a through-hole provided on the annular yoke 42.

The conductor 43C, the fuel introduction pipe 61, the groove 57 and the flange 56 of the stationary core 50, and the A-A reference plane are molded by a resin to be covered by a resin compact 71.

A plug supplied with electric power from a battery electric source is connected to a connector 71 formed at a tip end of the conductor 43C and a controller (not shown) controls energization and deenergization.

As shown in FIG. 2, while an electric current is carried to the electromagnetic coil 43, magnetic flux passing through the magnetic path BH produces a magnetic attraction between the anchor 15 of the movable member 10 and the stationary core 50 in the magnetic gap Ga, so that the anchor 15 is attracted by a force, which exceeds a set load of the spring 52, to move upward. At this time, the anchor 15 engages with the head 13 of the plunger to move upward together with the plunger 11 until the upper end surface of the anchor 15 collides against the lower end surface of the stationary core 50.

Consequently, the valve element 12 provided at the tip end of the plunger 11 separates from the valve seat 39 to permit a fuel to pass through the fuel passage F to be injected into the combustion chamber from the plurality of the fuel injection ports 37.

When energization of the electromagnetic coil 43 is interrupted, magnetic flux in the magnetic path BH disappears and the magnetic attraction in the magnetic gap Ga also disappears.

In this state, a spring force of the initial load setting spring 52, which pushes the cylindrical-shaped head 13 of the plunger 11 in an opposite direction, overcomes a force of the spring 16 to act on the movable member 10.

Consequently, the movable member 10 having lost the magnetic attraction is pushed back to a closing position, in which the valve element 12 comes into contact with the valve seat 39, by the spring force of the initial load setting spring 52.

At this time, the cylindrical-shaped head 13 engages with the anchor 15 and the anchor 15 overcomes a force of the spring 16 to move toward the plunger guide 11A.

When the valve element 12 collides against the valve seat 39 vigorously, the plunger 11 springs back in a direction, in which the initial load setting spring 52 is compressed.

Since the anchor 15 is structured separately from the plunger 11, however, the plunger 11 tries to separate from the anchor 15 to move in an opposite direction to movements of the anchor 15. At this time, friction by fluid is generated between the outer periphery of the plunger 11 and the inner periphery of the anchor 15 and energy of the plunger 11 springing back is absorbed by an inertial mass of the anchor 15, which is caused by an inertial force to be about to move in an opposite direction (valve closing direction).

At the time of springing-back, the anchor 15 having a large inertial mass is separated from the plunger 11, so that spring-back energy itself is decreased.

Also, the anchor 15 having absorbed the spring-back energy of the plunger 11 is correspondingly decreased in its inertial force, energy, by which the spring 16 is compressed, is decreased and the spring 16 is decreased in repulsion, so that there is not generated a phenomenon, in which the plunger 11 is moved in a valve opening direction by a spring-back phenomenon of the anchor 15 itself.

Thus, spring-back of the plunger 11 is restricted to a minimum, so that a so-called secondary injection phenomenon is suppressed, in which after an electric current carried to the electromagnetic coil 43 is interrupted, the valve is opened and a fuel is injected unintentionally.

With the embodiment constructed in the manner described above, a long-nozzle type electromagnetic fuel injection valve being small in size and lightweight is obtained since materials of parts except those members, which constitute a magnetic path, are made as thin or small as possible in wall thickness and diameter.

Also, since the metallic cylindrical-shaped vessel is seamless and can be made adequately short in size, it is possible to provide a fuel injection valve, which is favorable in magnetic property, high in formability, small-sized and inexpensive.

Further, an assembling work is made simple since the movable member can be assembled in an interior of the metallic cylindrical-shaped vessel by inserting the movable member through the through-holes of the stationary core and the anchor after the stationary core and the anchor are assembled to the metallic cylindrical-shaped vessel.

The movable member is regulated in stroke by using a jig to push the head of the movable member, which is caused to fall from the through-hole of the stationary core, ascertaining contact of the valve element with the valve seat, and measuring the position of contact. A position of the upper end of the anchor is beforehand measured and a difference in dimension between the position of the upper end of the anchor and a position of the upper end of the head of the stationary core is found. An adjustment spacer (shim) beforehand prepared is mounted between the lower end of the head of the plunger and the upper end surface of the anchor so that the difference amounts to a preset value, and then the plunger is reassembled.

Alternatively, a plurality of plungers having different lengths are prepared and a plunger, of which the difference in dimension assumes a tolerance, is selected and reassembled.

Finally, the initial load setting spring is caused to fall, thereafter the regulator is inserted into the through-hole of the stationary core to be regulated so that an initial load assumes a predetermined value, the regulator is fixed, and the spring and the movable member are fixed.

A method of assembling the electromagnetic fuel injection valve according to the embodiment and materials of respective parts will be described in detail with reference to FIGS. 4 to 13.

Figure 4:
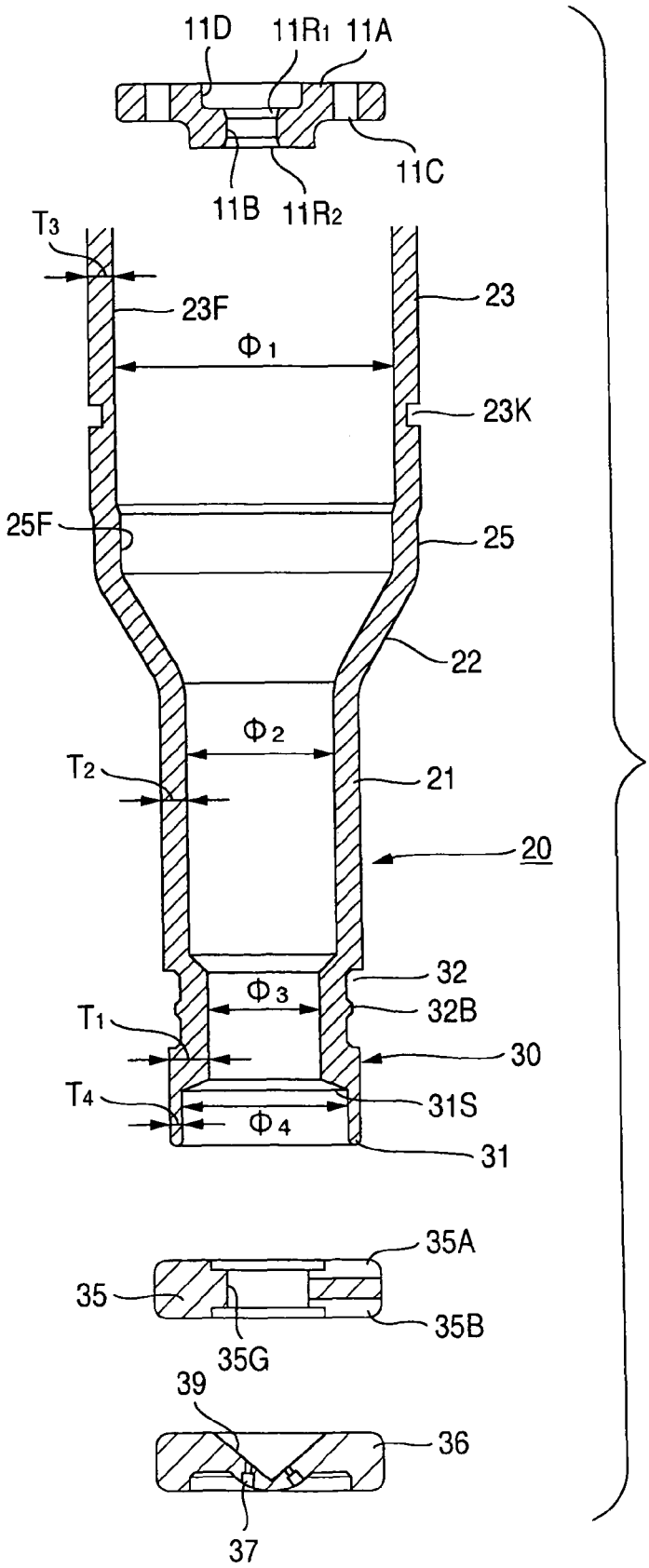
FIG. 4 is a view illustrating assembly of the electromagnetic fuel injection valve according to the first embodiment.
Figure 5:
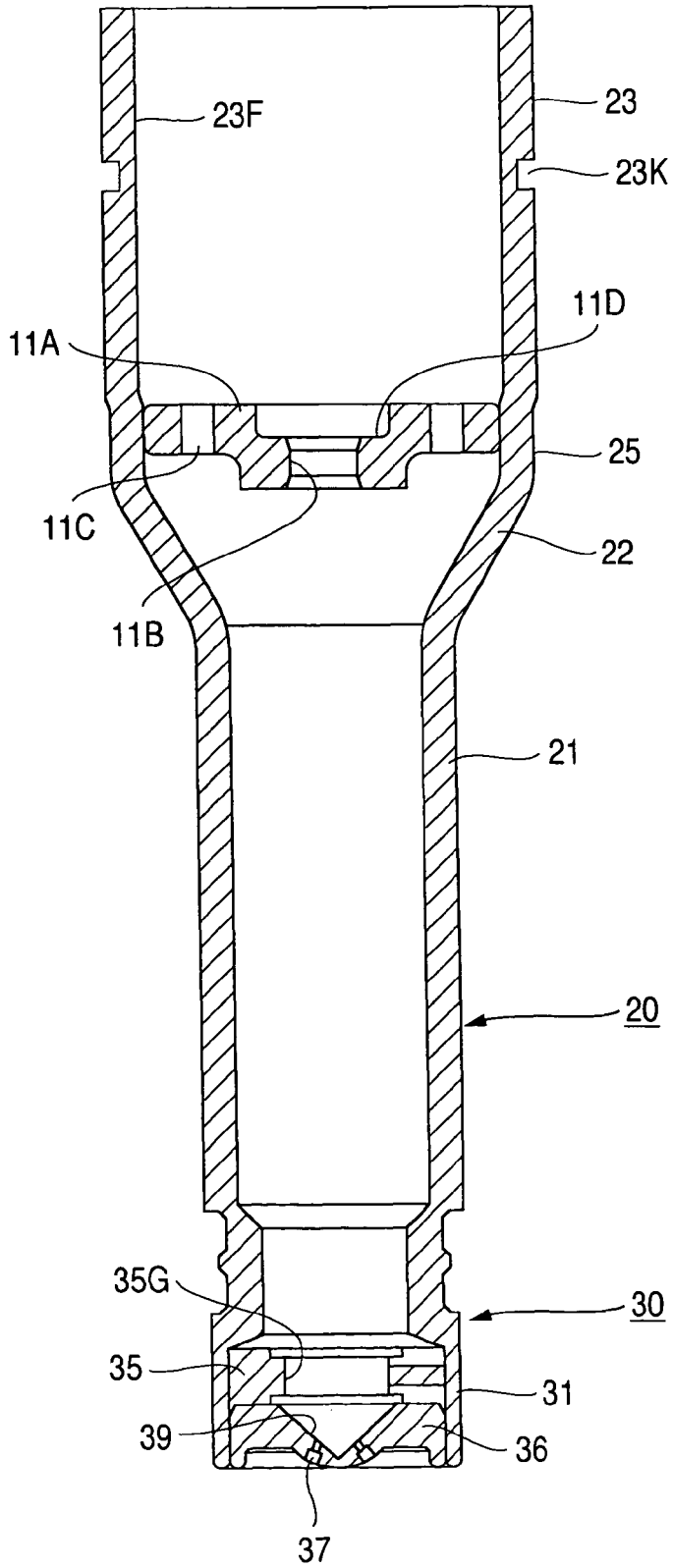
FIG. 5 is a view illustrating assembly of the electromagnetic fuel injection valve according to the first embodiment.

FIG. 4 is a cross sectional view showing a state of the metallic cylindrical-shaped vessel 20 after being worked, and showing the plunger guide 11A, the guide member 35, and the orifice plate 36, which are assembled thereto. FIG. 5 is a cross sectional view showing a whole, in which the plunger guide 11A, the guide member 35, and the orifice plate 36 are assembled to the metallic cylindrical-shaped vessel 20.

According to the embodiment, ferrite stainless steel being a magnetic material and specified by SUS430F in Japan Industrial Standards is used for the metallic cylindrical-shaped vessel 20 and press-forming and drawing are repeated plural times to integrally form the large-diameter cylindrical-shaped portion 23, the conical section portion 22, the small-diameter cylindrical-shaped portion 21, and the nozzle body 30. Also, when a cylinder is changed in wall thickness for regulation of magnetic property and necessary portions are subjected to processings of weak magnetization or non-magnetization, it is also possible to use SUS430, SUS420J2, or other martensitic stainless steel. Austenite stainless steel being a non-magnetic material can also be used, in which case necessary portions are magnetized contrary to the above to form a magnetic path. The following features are taken account of in selection of materials.

1. Excellent bending, deep drawing, and burring properties
2. Good anticorrosion to moisture content in gasoline
3. Good workability and anticorrosion of welds
4. Resistance to oxidation and thermal deformation at high temperatures Since the large-diameter cylindrical-shaped portion 23, the conical section portion 22, the small-diameter cylindrical-shaped portion 21, and the nozzle body 30 are not monotonously increased or decreased in inside and outside diameters and wall thickness but are changed complexly, good formability is one of important reasons of selection.

Specifically, with the nozzle part, formed on both sides of a portion having a minimum inside diameter $\phi$3 are portions having larger inside diameters $\phi$2 and $\phi$4 than the former inside diameter. Also, the wall thickness is varied in the manner of $T_3<T_2<T_1$ over an extent from the large-diameter cylindrical-shaped portion 23 to the nozzle body 30 and the distal cylindrical-shaped portion 31 is formed to be thinner ($T_4$) than the remaining portions.

Since the large-diameter cylindrical-shaped portion 23 is used in a position to divide (magnetic flux passes perpendicularly) a magnetic path of an electromagnetic coil device 40, its wall thickness $T_3$ is made thinner than the remaining portions so that the electromagnetic coil device 40 is not deteriorated in magnetic property.

A press-fit surface 23F, into which the outer peripheral surface of the stationary core 50 is fitted, and a press-fit surface 25F, into which an outer periphery of the plunger guide 11A is fitted, are formed on the inner peripheral surface of the large-diameter cylindrical-shaped portion 23, and an outer periphery corresponding to the press-fit surface 25F is subjected to drawing, and the drawn portion 25 is slightly smaller in diameter than the large-diameter cylindrical-shaped portion 23.

Also, a groove 23K is formed on an outer periphery of that portion, on which the lower end surface of the stationary core 50 is positioned. The groove 23K serves to decrease a cross sectional area of that path of the large-diameter cylindrical-shaped portion 23, which makes a path of leaking magnetic flux, in order that magnetic flux flowing between the stationary core 50 and the anchor 15 becomes hard to leak.

A portion of the nozzle body 30 contiguous to the small-diameter cylindrical-shaped portion 21 is formed to have a larger wall thickness $T_1$ than that of the remaining portions. This is because it is necessary to form a groove permitting a sealing member to be mounted to an outer periphery of the portion and to form a stepped surface 31S having a diameter $\phi$4 and permitting the guide member 35 and the orifice plate 36 to be inserted thereinto and held thereon.

A tip end of the metallic cylindrical-shaped vessel 20 is thinnest in wall thickness, and the guide member 35 and the orifice plate 36 are inserted into and fixed to the cylindrical-shaped portion 31 having a diameter $\phi$4.

An outside diameter of the guide member 35 is slightly smaller than the inside diameter $\phi$4 of the cylindrical-shaped portion 31, and when the guide member is positioned centrally, there is provided a clearance of around 100 microns between it and an inside diameter portion of the guide member 35.

The orifice plate 36 is press fitted into the inside diameter portion of the cylindrical-shaped portion 31. When an element for centering is inserted into the orifice plate in a final stage of working and put into a guide hole 35G centrally of the guide member 35, the guide member 35 is automatically aligned in the range of 100 microns to be centered.

In this state, the orifice plate 36 is welded at a surface thereof in contact with the cylindrical-shaped portion 31. The orifice plate 36 can use, for example, stainless steel specified by SUS420J in Japan Industrial Standards and having excellent abrasion resistance and anticorrosion.

Since the valve element 12 collides against the valve seat 39, stainless steel is selected as a material, of which abrasion resistance is demanded and which is favorable in welding to be compatible with a material of the cylindrical-shaped portion 31.

The guide member 35 can use, for example, a sintered alloy made of nickel alloy. The sintered alloy is selected as a material of good productivity and good abrasion resistance since it is required that the guide member 35 be provided centrally thereof with a slide surface as a guide of the plunger 11 (or the valve element 12) and formed on upper and lower surfaces thereof with complex, uneven surfaces.

A stepped surface 35A is provided on an upper surface of the guide member 35 and a radial fuel passage directed outward from inward is formed between the stepped surface and a stepped surface 31A of the cylindrical-shaped portion 31. Several cut surfaces are formed on a side of the guide member 35 and a longitudinal fuel passage is formed between the cut surfaces and an inner peripheral surface of the cylindrical-shaped portion 31.

Further, a plurality of radial grooves 35B are provided on an underside of the guide member 35 to form fuel passages directed inward from the longitudinal passage.

The radial grooves 35B are provided offset from an central axis of the guide hole 35G, so that the moment the valve element 12 separates from the valve seat 39, a fuel reaches the valve seat 39 of the orifice plate 36 while swirling. If the radial grooves 35B were provided to be directed toward the central axis of the guide hole 35G, a fuel would flow straight toward the center of the valve seat 39 of the orifice plate 36. A fuel having flowed into the valve seat 39 is injected from the plurality of fuel injection ports 37.

The plunger guide 11A is provided centrally thereof with the guide surface 11B, by which the plunger 11 is guided and around which a recess 11D for bearing of a spring is formed. Also, an outer periphery of the plunger guide is press fitted into an inner surface of the drawn portion 25.

Under such conditions, a stainless alloy specified by, for example, SUS420J2 in Japan Industrial Standards is used as a material, which is easy to perform press working and has an abrasion resistance and anticorrosion to moisture content in gasoline.

Upper and lower ends of the guide surface 11B are chamfered to form rounded surfaces 11R1, 11R2. This is intended for forming a slide contact surface between the plunger 11 and an inner surface of the guide hole 11B in a narrow region to make one-side hitting hard to occur and to remove burr generated at the time of working.

Figure 6:
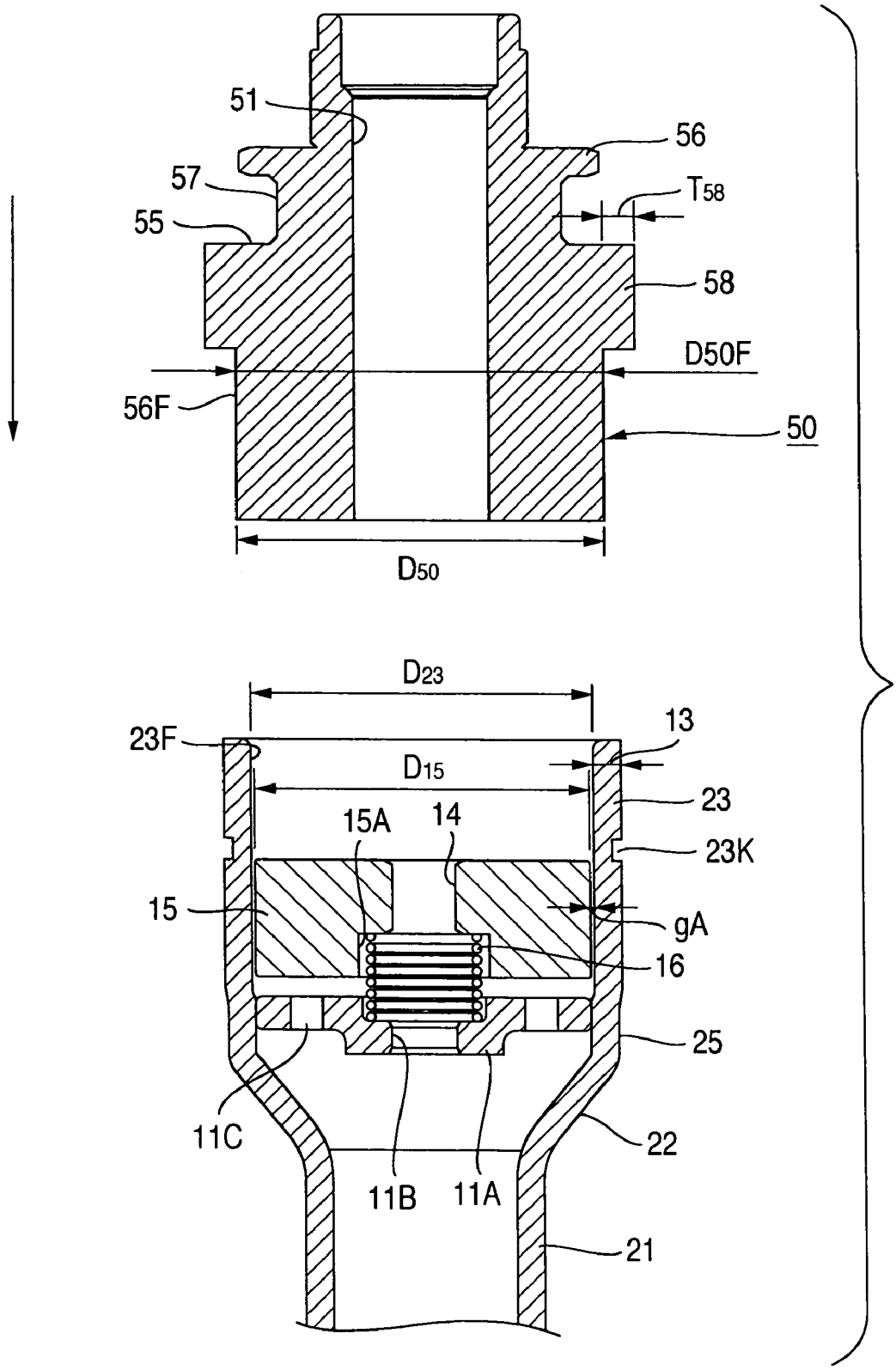
FIG. 6 is a view illustrating assembly of the electromagnetic fuel injection valve according to the first embodiment.
Figure 7:
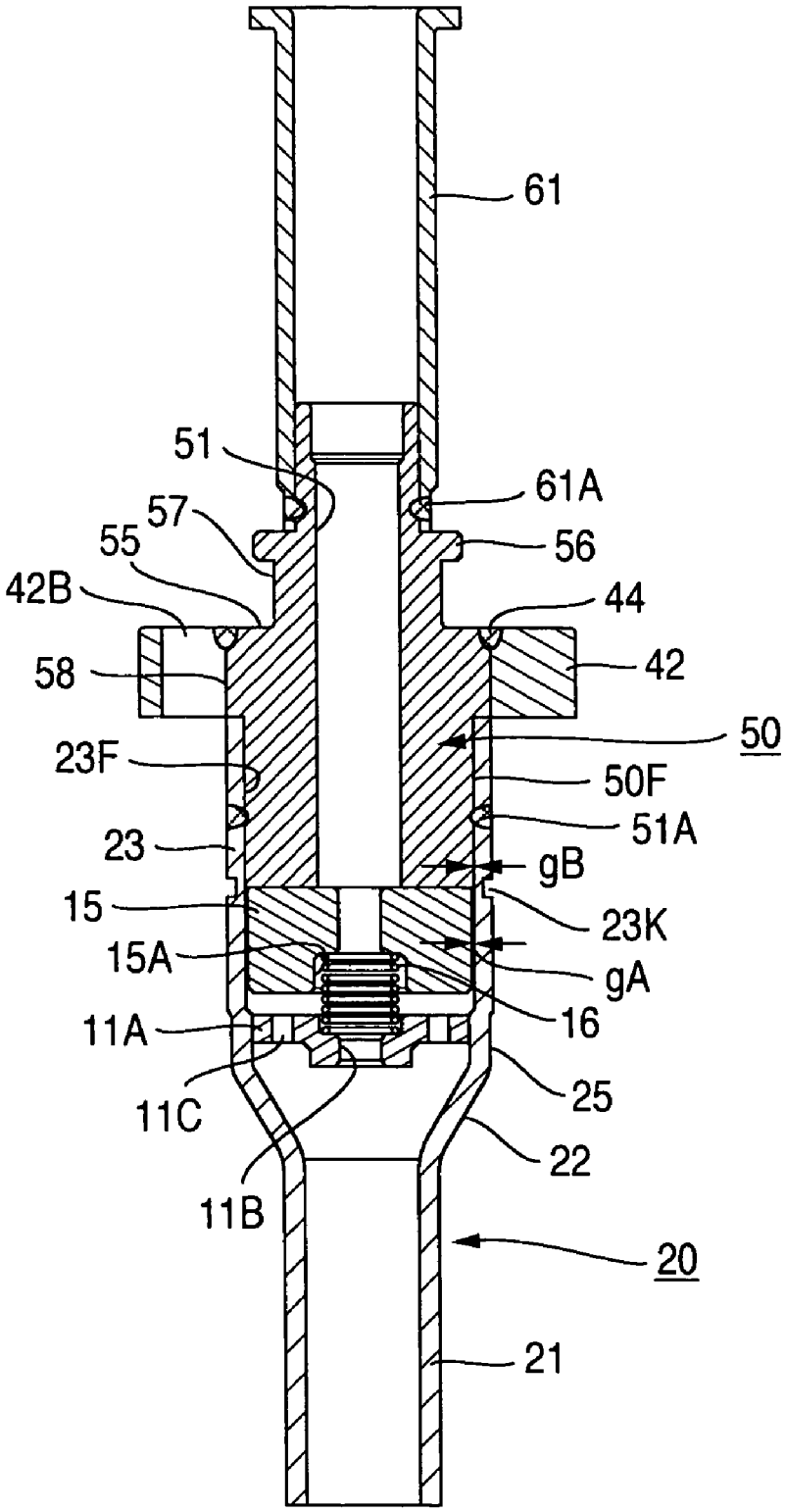
FIG. 7 is a view illustrating assembly of the electromagnetic fuel injection valve according to the first embodiment.

FIG. 6 is a view showing a process, in which the anchor 15, the second spring 16, and the stationary core 50 are assembled to the metallic cylindrical-shaped vessel 20 and assembling thereto the plunger guide 11A, the guide member 35, and the orifice plate 36 as shown in FIGS. 4 and 5, and FIG. 7 is a view showing a state, in which these elements are assembled.

The spring 16 (second spring) specified as a material, which is high in strength and anticorrosion to moisture content in gasoline, by, for example, SUS631-WPC in Japan Industrial Standards is set in the recess 11D provided centrally of the plunger guide 11A fixed to the metallic cylindrical-shaped vessel 20, and the anchor 15 is arranged in the large-diameter cylindrical-shaped portion 23 so that an upper portion of the spring 16 is fitted into the recess 15A provided centrally of the anchor 15. At this time, the upper end surface of the anchor 15 is just in agreement with a position of the annular groove 23K. The anchor 15 is formed from a magnetic stainless steel, which is suited to forging and good in formability, and has at least an end surface thereof, which collides against the stationary core 50, and a surface therearound plated with chromium (Cr) or Ni (nickel).

Since an outside diameter D15 of the anchor 15 is smaller by about 0.2 millimeter than an inside diameter D23 of the large-diameter cylindrical-shaped portion 23, a gap gA of about 0.1 millimeter is formed between an outer periphery of the anchor 15 and an inner periphery of the large-diameter cylindrical-shaped portion 23 at this time.

The gap gA is very important. When the fuel injection valve is mounted on a vehicle, the state of mounting is various. In the case where the fuel injection valve is inclined to the vertical to be mounted, the anchor 15 placed on the spring 16 is inclined under the influence of the gravitational force. When the anchor 15 is inclined and upper and lower edges of an outer periphery of the anchor 15 comes into contact with the inner peripheral surface of the large-diameter cylindrical-shaped portion 23, the anchor 15 cannot move up and down smoothly.

In order to avoid such state, a gap between the plunger 11 and the inner peripheral surface of the through-hole 14 of the anchor 15 is set as small as possible, for example, 5 to 15 microns and the gap gA is set to 0.1 millimeters. Thereby, even in the case where the anchor 15 is put in a worst inclined state in practical use, the anchor 15 can move up and down smoothly. Also, a chromium layer plated on the inner peripheral surface of the through-hole 14 functions as a protective film for sliding relative to the plunger 11.

Subsequently, a press fit surface 50F of the stationary core 50 is press fitted into the inner peripheral surface 23F of the large-diameter cylindrical-shaped portion 23. An outside diameter 50F of the press fit surface 50F of the stationary core 50 is formed to be larger than an outside diameter 50 of an end of the stationary core 50 toward the anchor 15.

By providing the press fit surface on the stationary core 50, an unnecessary stress is not applied to the large-diameter cylindrical-shaped portion 23 at the time of press fitting and even when the large-diameter cylindrical-shaped portion 23 is formed thin, such portion is not deformed when the stationary core 50 is press fitted. Also, a gap gB formed by a difference between an outside diameter D5 of the end of the stationary core 50 toward the anchor 15 and the inside diameter D23 of the large-diameter cylindrical-shaped portion 23 after press fitting of the stationary core 50 functions to permit such portion of the metallic cylindrical-shaped vessel 20 to be formed as a weak magnetic portion or a non-magnetic portion and to cooperate with the annular groove 23K to suppress magnetic flux leaking from opposed surfaces of the stationary core 50 and the anchor 15.

A thickness D58 of the flange 58 provided on the stationary core 50 is set to the same value as that of a thickness $T_3$ of the large-diameter cylindrical-shaped portion 23.

Thus, the stationary core 50 press fitted into the large-diameter cylindrical-shaped portion 23 is welded at 51A on a whole outer periphery opposed to the press fit surface 50F. In this state, end surfaces of the stationary core 50 and the anchor 15 are put in a light contact state. The annular groove 23K is positioned in an outer peripheral region corresponding to a position of the contact portion.

The stationary core 50 is made of the same material as that of the anchor 15 and has a surface thereof, which collides against the anchor 15, and a surface therearound plated with chromium (Cr) in the same manner as the anchor 15 (according to the embodiment, chromium plating is adopted but nickel plating may be adopted).

The chromium plating functions to relieve a shock when the stationary core and the anchor collide against each other and to suppress a secular change of a surface condition.

Thereafter, the annular yoke 42 is press fitted onto the outer periphery of the flange 58 of the stationary core 50 so that a surface of the shoulder 55 of the stationary core 50 and the upper end surface of the annular yoke 42 are made flush with each other. The flange 58 and the annular yoke 42 are set to the same value in thickness. The both elements are welded wholly circumferentially at contact portions of upper end surfaces thereof to be fixed to each other.

The annular yoke 42 is formed annular by press-forming of the same material as those of the stationary core 50 and the anchor 15. A punched portion 42B is provided partially circumferentially of the annular yoke and a terminal of a coil is taken out from the punched portion 42B.

Subsequently, the fuel introduction pipe 61 is press fitted onto an outer periphery of a projecting portion at an upper end of the stationary core 50 to reach the flange 56 to be welded at the press-fit outer periphery 61A. The fuel introduction pipe 61 uses, for example, stainless steel specified by SUS304 in Japan Industrial Standards as a material (it is unnecessary to take account of magnetic property), which has an anticorrosion to moisture content in gasoline and affords press-forming (deep drawing).

Figure 8:
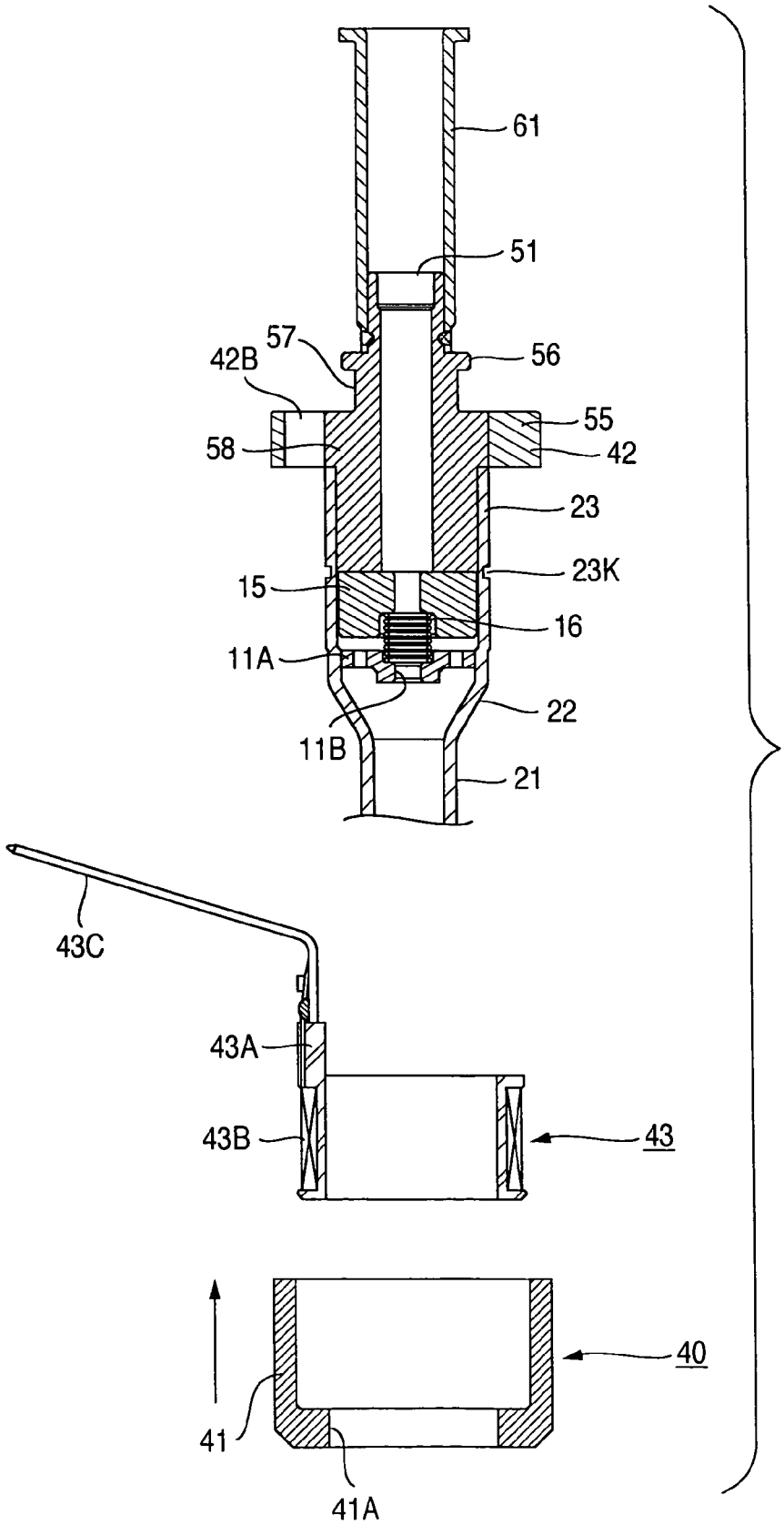
FIG. 8 is a view illustrating assembly of the electromagnetic fuel injection valve according to the first embodiment.
Figure 10:
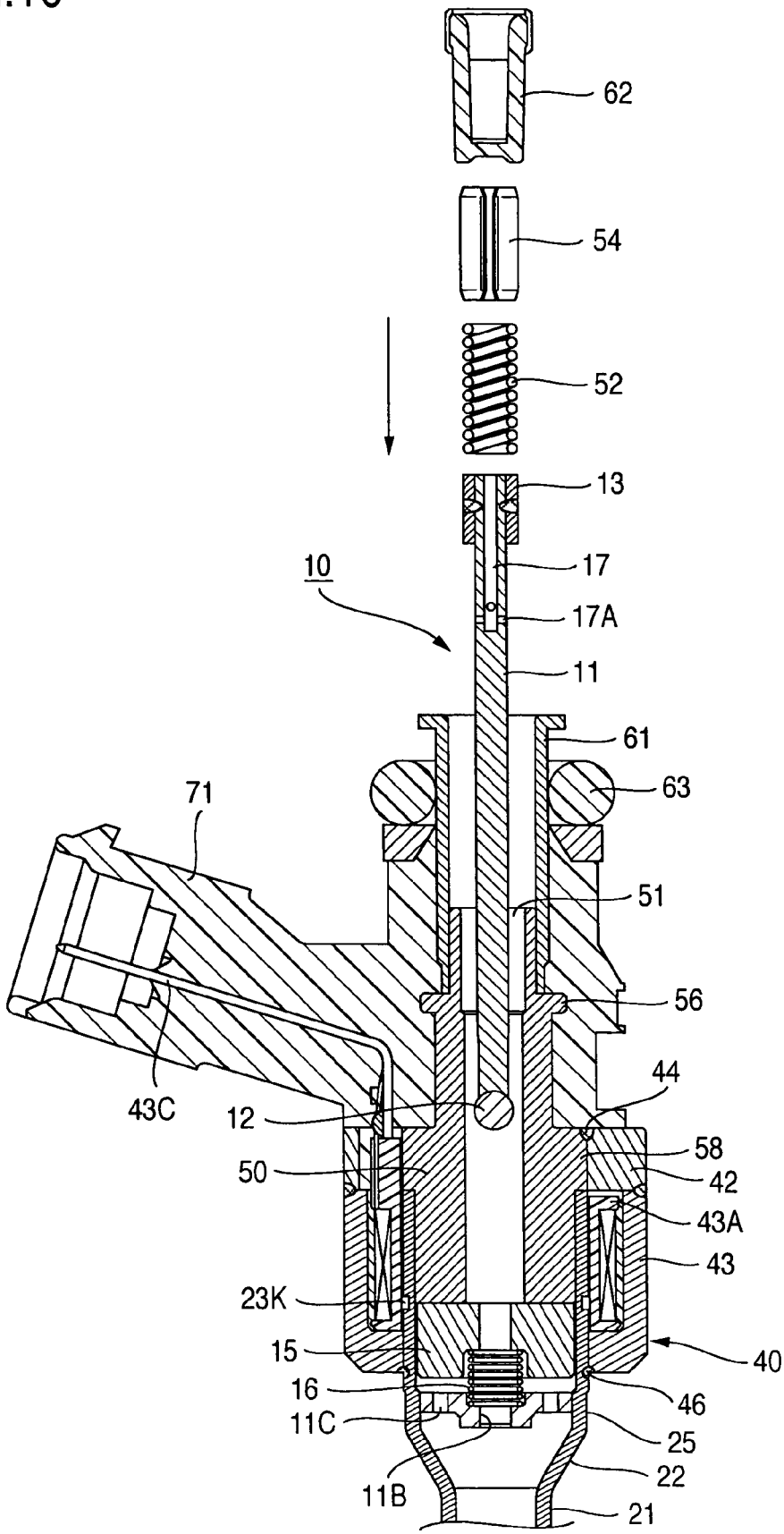
FIG. 10 is a view illustrating assembly of the electromagnetic fuel injection valve according to the first embodiment.

FIG. 8 is a view showing a process, in which the electromagnetic coil device 40 is mounted to an outer periphery of the assembly illustrated in FIG. 7. Also, FIG. 10 is an assembly drawing showing a state, in which the electromagnetic coil device 40 is assembled.

The electromagnetic coil device 40 comprises the electromagnetic coil 43 with the annular coil 43B wound around the annular coil bobbin 43A, and the outer yoke 41.

The electromagnetic coil 43 is inserted into an assembly from a side toward the nozzle body 30. The conductor 43C is taken out through the punched portion 42B of the annular yoke 42.

The cup-shaped yoke 41 is inserted from the side toward the nozzle body 30 and an inner peripheral surface of the through-hole 41A on the bottom is press fitted onto the outer periphery of the large-diameter cylindrical-shaped portion 23. Press fitting is carried out until the upper end surface of the cup-shaped yoke 41 abuts against the lower end surface of the annular yoke 42. As shown in FIG. 10, a whole circumference is welded at 45 on contact portions of the outer peripheral edge of the lower end of the annular yoke 42 and the outer peripheral edge of the upper end of the cup-shaped yoke 41.

Likewise, a whole circumference is welded at 46 on contact portions of the inner peripheral edge of the lower end of the cup-shaped yoke 41 and the outer peripheral surface of the large-diameter cylindrical-shaped portion 23.

An inner peripheral edge of the bottom of the cup-shaped yoke 41 is positioned to face the outer peripheral surface of the anchor.

Thus, the toroidal magnetic path BH surrounding the annular coil 43 is formed to pass through the cup-shaped yoke 41, the anchor 15, the stationary core 50, the annular yoke 42, and the cup-shaped yoke 41.

The cup-shaped yoke 41 uses stainless steel, which is good in workability, to take account of magnetic property.

After being assembled in this state, a resin material is used to mold a periphery of the fuel introduction pipe 61, the periphery of the projecting portion, which includes the flange 56, at the upper end of the stationary core 50, the coil terminal 43C, a periphery of the electromagnetic coil 43 (in the cup-shaped yoke 41), the upper end surface of the annular yoke 42, and the shoulder 55 of the stationary core.

Figure 9:
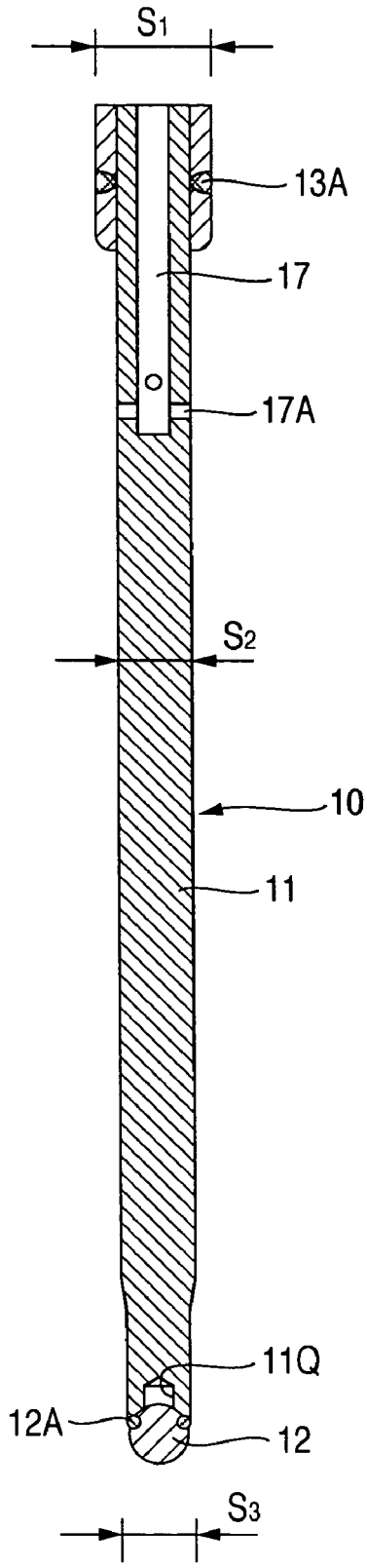
FIG. 9 is a view illustrating assembly of the electromagnetic fuel injection valve according to the first embodiment.

FIG. 9 is a cross sectional view showing a state, in which assembly of the movable member 10 is completed, and FIG. 10 is a view illustrating a state, in which the movable member 10 is assembled to an assembly after the resin is molded.

The plunger 11 of the movable member 10 uses the same material (SUS420J2) as that of the plunger guide 11A as a material, which is weak in magnetism and has abrasion resistance and anticorrosion to moisture content in gasoline. Thereby, since the slide portion of the plunger guide 11A comes into slide contact with the same material, it is favorable in durability. An upper end of the plunger 11 is formed centrally thereof with the hole 17, which serves as a fuel passage, and with plurality of small holes 17A, which extend radially of the hole 17. The cylindrical-shaped head 13 made of the same material as that of the plunger is fitted onto an outer periphery of that portion of the plunger 11, on which the hole 17 is formed, and an outer periphery of the fitted portion is welded wholly circumferentially at 13A.

A recess 11Q is formed at a tip end of the plunger 11, an outer periphery of the ball-shaped valve element 12 made of the same material as that of the plunger is partially fitted into the recess 11Q, and a whole periphery of the contact portion is welded at 12A.

A diameter S1 of the head 13 among diameters of various parts of the movable member 10 is largest, and a diameter S2 of the plunger 11 and a diameter S3 of the valve element 12 are large in this order, all the diameters being smaller than an inside diameter of the through-hole 51 of the stationary core 50.

Also, the valve element 12 and the plunger 11 are smaller in diameter than the through-hole 14 of the anchor 15, the guide surface 11B of the plunger guide 11A, and the guide hole 35G of the guide member 35. Consequently, after the stationary core 50, the anchor 15, the plunger guide 11A, and the guide member 35 are assembled, the movable member 10 can be assembled finally.

The movable member 10 is inserted into the assembly and its stroke is measured. A shim for stroke regulation having an appropriate thickness and interposed between the lower end surface of the head 13 and the upper end surface of the anchor 15 is selected according to a measured value.

Also, the movable member may be replaced by a movable member having an appropriate length according to a measured value. In the both methods, stroke regulation can be made after the stationary core 50 and the anchor 15 of the electromagnetic drive mechanism are all assembled, so that stroke regulation is simple.

Thus after the movable member being optimum in stroke is set, the first spring 52 is caused to fall on the head 13 of the movable member 10.

Finally, the regulator 54 is press fitted into the through-hole 51 of the stationary core 50, an initial load is regulated, and the spring 52 is fixed, whereby assembly is completed.

Second Embodiment

Figure 11:
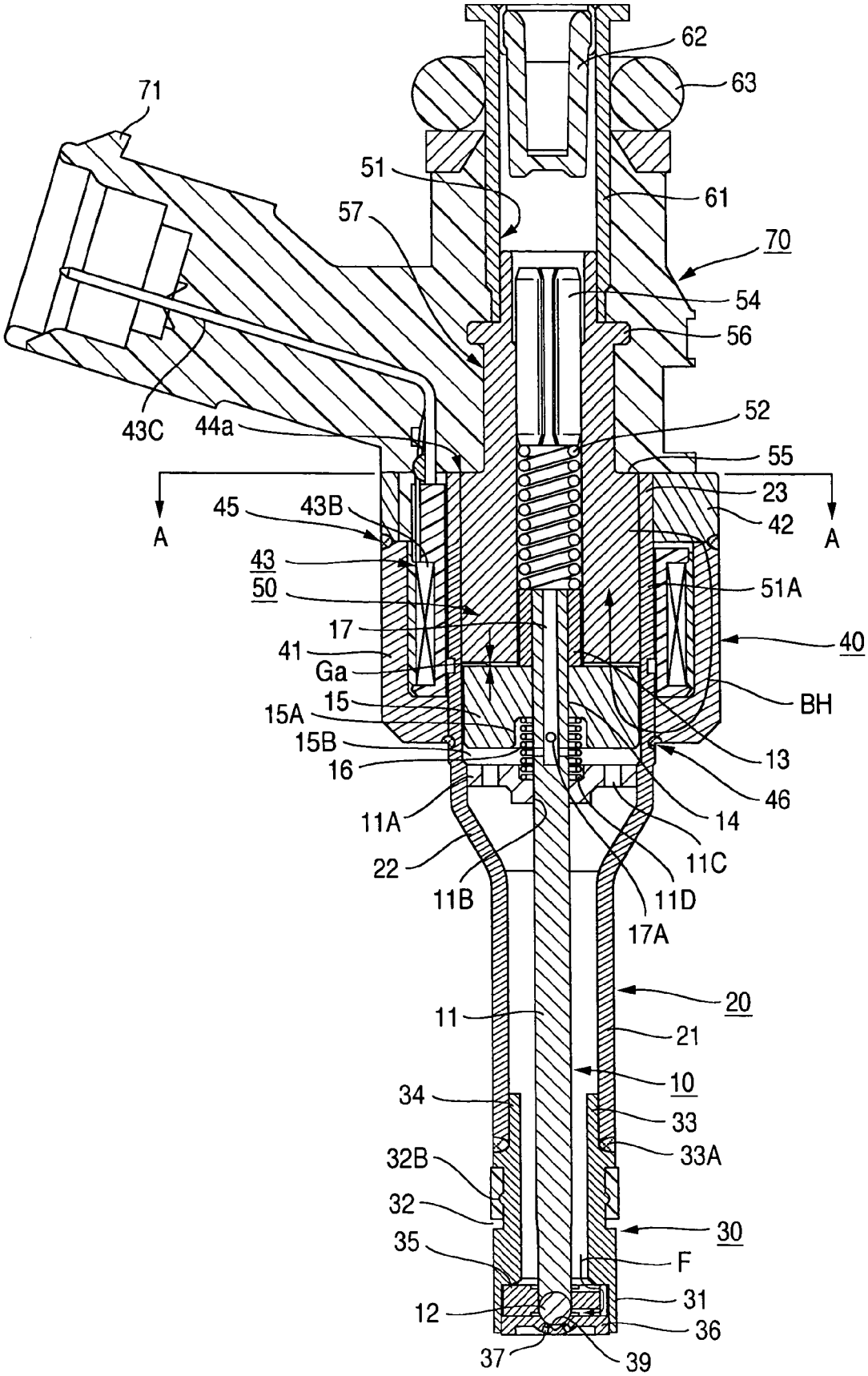
FIG. 11 is a longitudinal, cross sectional view showing an electromagnetic fuel injection valve according to a second embodiment.

A second embodiment, for which the invention is used, will be described with reference to FIG. 11. First, only portions different from those of the first embodiment will be described specifically.

A cylindrical-shaped portion 33 being inserted into an inside diameter portion of an opening at a tip end of a small-diameter cylindrical-shaped portion 21 is formed on an end of a nozzle body 30 and fixed at a whole circumferential weld 33A to a spigot joint portion 34.

The nozzle body 30 is the same in outside diameter as the small-diameter cylindrical-shaped portion 21 of a metallic cylindrical-shaped vessel 20. Therefore, the sum of dimensions of a wall thickness of the cylindrical-shaped portion 33 of the nozzle body 30 and a wall thickness of the small-diameter cylindrical-shaped portion 21 of the metallic cylindrical-shaped vessel 20 makes a wall thickness of the nozzle body 30.

A cylindrical-shaped portion 31 of the nozzle body 30 is uniform in outside diameter up to its tip end and thinner in wall thickness than the remaining portions thereof with the result that a foremost end of the nozzle body 30 is enlarged in inside diameter about the cylindrical-shaped portion 31 to form a portion, into which a guide member 35 and an orifice plate 36 are inserted.

In this manner, the nozzle body 30 being complex in shape is formed separate from the metallic cylindrical-shaped vessel 20 and thereafter joined integrally whereby the work of processing of the metallic cylindrical-shaped vessel 20, processing of the nozzle body 30, and insertion and assembly of the guide member 35 and the orifice plate 36 is facilitated.

In particular, the work of processing of the nozzle body 30, insertion and assembly of the guide member 35 and the orifice plate 36, and the work of processing of the metallic cylindrical-shaped vessel 20 can be proceeded simultaneously in separate work lines, so that a total working hour is shortened even taking account of a final joining work.

A valve element 12 is formed integrally at a tip end of a lengthy plunger 11 of the movable member 10 by means of cutting and a cylindrical-shaped head 13 having a larger outside diameter than a diameter of the plunger 11 is formed integrally on the other end thereof.

In this manner, in the case where the movable member 10 is formed as an integral body from the same member, parts control of the movable member is easy to perform and the work of assembly is made simple.

While the plunger 11 and the cylindrical-shaped head 13 of the movable member 10 are wholly made of a solid metal, a fuel passage hole 17 is formed centrally to extend to a position about a plunger guide 11A from an upper end of the cylindrical-shaped head 13 and communicated to a fuel passage 15B around an outer periphery of the plunger 11 through a plurality of radial holes 17A positioned on a spring bearing recess 15A of an anchor 15.

According to the embodiment, a stationary core 50 is press fitted in an axial direction until a shoulder 55 of the stationary core 50 agrees with an A-A plane, on which an upper end surface of a large-diameter cylindrical-shaped portion 23 of the metallic cylindrical-shaped vessel 20 is positioned, whereby axial positioning of the stationary core 50 and the large-diameter cylindrical-shaped portion 23 of the metallic cylindrical-shaped vessel 20 is achieved.

An annular yoke 42, through which the large-diameter cylindrical-shaped portion 23 of the metallic cylindrical-shaped vessel 20 extends, is formed to have substantially the same inside diameter as an outside diameter of the large-diameter cylindrical-shaped portion 23 of the metallic cylindrical-shaped vessel 20, and the annular yoke 42 is substantially the same in outside diameter as a cup-shaped yoke 41.

Axial positioning of an electromagnetic coil device 40 and the large-diameter cylindrical-shaped portion 23 of the metallic cylindrical-shaped vessel 20 is achieved by fixing them in a state, in which an upper end surface of the annular yoke 42 is caused to agree with the reference plane A-A.

Consequently, all the upper end surface of the annular yoke 42, the upper end surface of the large-diameter cylindrical-shaped portion 23 of the metallic cylindrical-shaped vessel 20, and the shoulder 55 of the stationary core 50 are positioned on the same plane as the reference plane A-A.

The annular yoke 42 is fixed to an outer periphery of the large-diameter cylindrical-shaped portion 23 of the metallic cylindrical-shaped vessel 20 by performing welding annularly along a joined surface 44 of an inner peripheral edge of an upper end of the annular yoke 42 and an outer peripheral edge of an upper end of the large-diameter cylindrical-shaped portion 23 of the metallic cylindrical-shaped vessel 20.

An electromagnetic fuel injection valve, which is small in assembly error and good in quality of assembly, is obtained by carrying out axial positioning of the stationary core and the electromagnetic coil device relative to the cylindrical-shaped vessel made of a metallic material relying on a single reference plane.

In addition, since those parts denoted by the same reference numerals as those in the first embodiment and not described in the second embodiment are the same in function as the latter in spite of being not the same in shape as the latter, the descriptions with respect to the first embodiment are applied.

Third Embodiment

Figure 12:
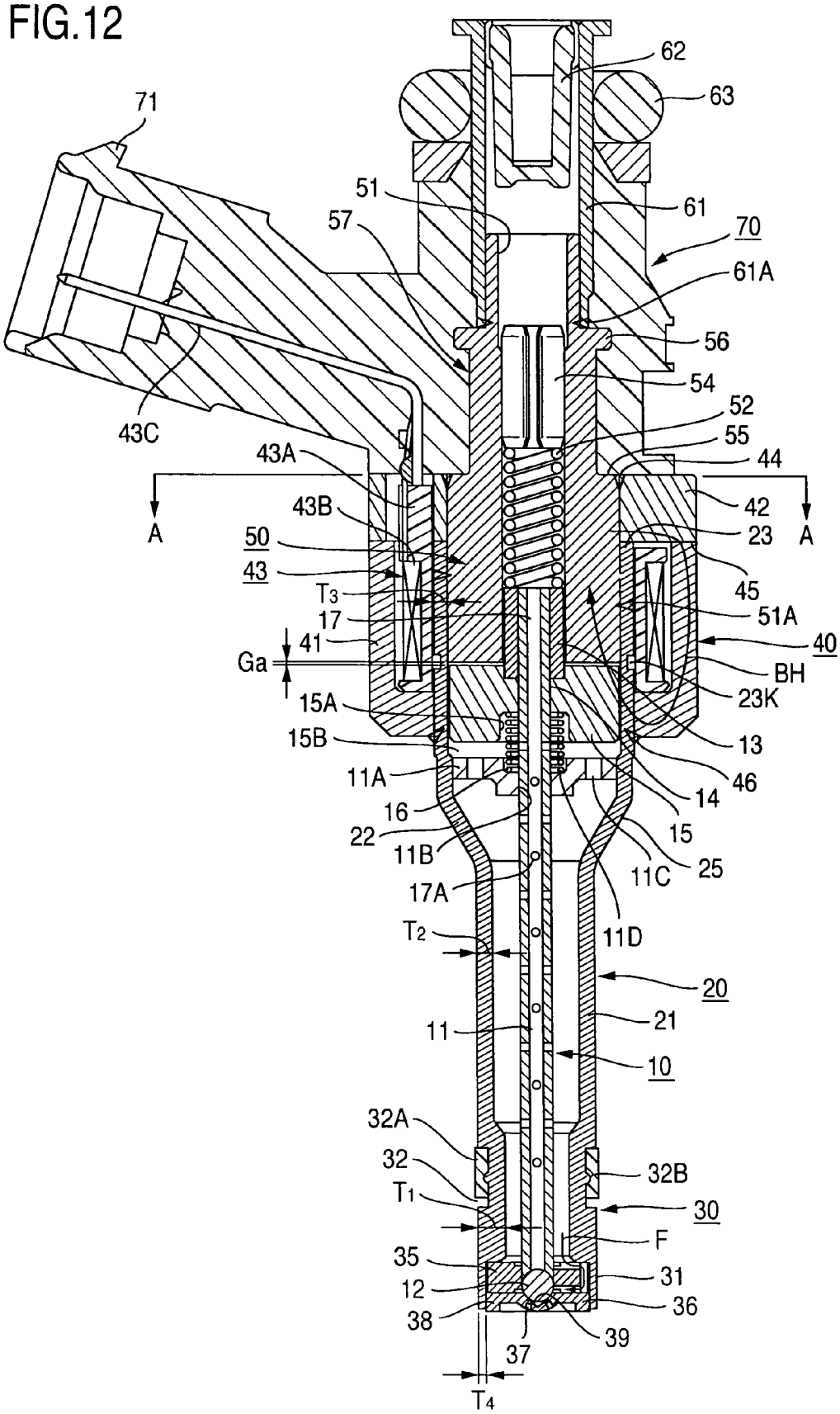
FIG. 12 is a longitudinal, cross sectional view showing the electromagnetic fuel injection valve according to the third embodiment.

A third embodiment, for which the invention is used, will be described with reference to FIG. 12. Only portions different from those of the first embodiment will be described specifically.

A plunger 11 is formed from a hollow member. The hollow member may be either a pipe material formed by curling a sheet material and welding a joined surface, or a pipe material worked to be hollow and cut.

According to the embodiment, a plurality of through-holes are formed on the hollow pipe material to make the plunger itself light in weight. This contributes to accelerate motions of a movable member 10. Also, since an adequate cross sectional area can be ensured for a fuel passage, it is possible to decrease a fuel in pressure loss, thus enabling to accelerate motions of the movable member 10.

A fuel is led to a position of a nozzle body 30 through the hollow plunger 11.

A recess 15H is provided centrally of a anchor 15 to receive therein a head 13 of the movable member 10, and the head 13 and the anchor 15 come into contact and engage with each other about a bottom of the recess 15H.

A diameter R2 of a hole formed on the bottom of the recess 15H of the anchor 15 is larger than a diameter R4 of the hollow plunger 11 and a diameter R1 of a valve element 12 but smaller than a diameter R3 of the head 13. With such construction, a fuel injection valve is obtained, in which the anchor 15 is less inclined and the movable member 10 is free of a posture of mount and smooth in motion.

According to the embodiment, a large-diameter cylindrical-shaped portion 23 extends upward beyond an upper end of a stationary core 50. While a diameter of the head 13 is smaller than a diameter D of a through-hole 51 of the stationary core 50 in the same manner as in the other embodiments, stroke regulation of the movable member 10 is finished and a spring 52 and a regulator 54 are fixed before a fuel introduction pipe 61 is fixed to an upper end of the large-diameter cylindrical-shaped portion 23.

After the fuel introduction pipe 61 is fixed to the upper end of the large-diameter cylindrical-shaped portion 23, a resin material is used to mold an electromagnetic coil device 40, an outer periphery of an upper portion of the large-diameter cylindrical-shaped portion 23, and a part of the fuel introduction pipe 61.

According to the embodiment, the stationary core 50 is made the same in outside diameter as a press fit portion of the large-diameter cylindrical-shaped portion 23 and a press fit portion of an annular yoke 42. Such construction produces an effect that the stationary core 50 can be made simple in shape. According to the embodiment, the upper end of the large-diameter cylindrical-shaped portion 23 is press fitted with a regulated spacing left on a lower end of the annular yoke 42 and the press fit portion thereof is welded at 51A.

While all the embodiments have been described with respect to an arrangement, in which the head 13 of the movable member 10 and the plunger 11 are wholly made of a non-magnetic material or a weak magnetic material, leakage of magnetic flux and a phenomenon of magnetization of the movable member 10 can be suppressed provided that a portion of the plunger between a plunger guide 11A and the head 13 is partially non-magnetic or weak-magnetic, so that a material may be exchanged partially, or processings of weak magnetization or non-magnetization may be applied partially.

While all the embodiments have been described with respect to an arrangement, in which the metallic cylindrical-shaped vessel 20 is made of a non-magnetic material or a weak magnetic material, a leakage magnetic path is hard to form provided that portions, which can make a leakage flux passage around a region, in which the stationary core 50 and the anchor 15 are opposed to each other with a gap Ga therebetween, are non-magnetic or weak-magnetic, so that such portions may be subjected to processings of non-magnetization or weak magnetization, or may be made of such member.

While the embodiment shown in FIGS. 1 and 3 has been described with respect to an arrangement, in which the cylindrical-shaped vessel made of a metallic material is press fitted onto the stationary core 50 until the upper end surface of the large-diameter cylindrical-shaped portion 23 abuts against the lower end surface of the flange 58 of the stationary core 50 or the annular yoke 42, the metallic cylindrical-shaped vessel 20 is actually press fitted to a predetermined position with the A-A plane as a reference, so that it does not abut against the lower end surface. Ordinarily, a spacing having a specified dimension is provided in order to make press-fit impossible. Consequently, the end surface of the large-diameter cylindrical-shaped portion 23 is opposed to the lower end surface of the flange 58 or the annular yoke 42 with a specified spacing therebetween. Further, while all the embodiments have been described with respect to an arrangement, in which the coil bobbin 43A of the electromagnetic coil device 40 includes the groove having a U-shaped cross section, the groove may be shaped such that a bottom portion is stepped and portions having many and small coil wound layers are mixed. In this case, winding can be provided in an inner, surplus space without a waste, so that the coil is increased in occupancy and it is possible to obtain an intense electromagnetic coil.

In addition, since those parts denoted by the same reference numerals as those in the first embodiment and not described in the third embodiment are the same in function as the latter in spite of being not the same in shape as the latter, the descriptions with respect to the first embodiment are applied.

In addition, while the first to third embodiments have been described with respect to an arrangement, in which the guide member 35 guides the tip end of the plunger 11 of the movable member 10, a construction can be made, in which the side of the valve element 12 is guided. With the former, a diameter (outside diameter) of the valve element 12 is smaller than an outside diameter of the plunger tip end portion. With the latter, a diameter (outside diameter) of the valve element 12 is larger than the outside diameter of the plunger tip end portion. In either case, however, these diameters are smaller than an inside diameter of the guide hole of the plunger guide 11A.

The invention is usable as a fuel injection valve for internal combustion engines. The invention is preferably used in a fuel injection valve for so-called in-cylinder injection type internal combustion engines, in which a fuel is directly injected into a cylinder, but not limited thereto.

The invention is usable as a port injection type fuel injection valve, which is mounted to an intake port inlet to permit a fuel to be injected toward an intake valve.

Also, the invention is preferably used for fuel injection valves of a type, in which a plunger is lengthy, but not limited thereto and is usable for fuel injection valves of a type, in which a plunger is short.

Also, application to an arrangement, in which a through-hole 51 as a fuel passage is provided in a stationary core and a movable member is assembled making use of the through-hole 51 as a fuel passage, is preferable but the through-hole is not necessarily a fuel passage. The technology of the invention is applicable to, for example, an arrangement called a side feed type, in which a fuel supply passage is provided on a side of a tip end of a fuel injection valve, provided that a through-hole intended for mounting of a movable member is provided in a stationary core.

Further, the invention is usable as a variable displacement control electromagnetic mechanism provided at a suction port or an overflow port of a high-pressure fuel pump to regulate a sucked amount or an overflow amount (return amount) of a fuel.

Also, the invention can be made wide use of as an electromagnetically operated plunger of a fluid metering mechanism or other movable plunger mechanisms for actuators, except internal combustion engines.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An electromagnetic fuel injection valve comprising:

a metallic cylindrical-shaped vessel provided at a tip end thereof with a fuel injection port, the other end thereof being closed by a stationary core provided centrally thereof with a through-hole;

a movable member arranged between the stationary core and the fuel injection port and provided at a tip end thereof with a valve element, which opens and closes the fuel injection port, a maximum outside diameter of the movable member being smaller than a minimum inside diameter of the through-hole; and an electromagnetic drive mechanism that reciprocates the movable member;

the electromagnetic drive mechanism comprising an anchor facing an axial end face of the stationary core to reciprocatingly cooperate with the stationary core;

the anchor is at a center thereof provided with a through-hole into which the movable member is inserted for a relative displacement;

the movable member comprises an engagement portion that engages with an axial engagement surface of the anchor on a side of the stationary core around the through-hole; and a maximum outside diameter of a portion of the movable member between the engagement portion and the valve element is smaller than a minimum inside diameter of the through-hole of the anchor.

2. An electromagnetic fuel injection valve according to claim 1, further comprising a guide element fixed to an inner periphery of the metallic cylindrical-shaped vessel between the stationary core and the fuel injection port and provided centrally thereof with a hole, by which the movable member is guided.

3. An electromagnetic fuel injection valve according to claim 2, wherein an outside diameter of the engagement portion is larger than an outside diameter of that portion of the movable member, which is guided by the guide element.

4. An electromagnetic fuel injection valve according to claim 1, further comprising a spring mounted in the through-hole to push a rear end of the movable member, and a regulator that regulates a position of the spring.

5. An electromagnetic fuel injection valve according to claim 1, wherein the movable member is made of a non-magnetic material or a weak magnetic material wholly or partially in the vicinity of a magnetic path formed by the electromagnetic drive mechanism, or subjected to a processing of non-magnetization or weak magnetization.

6. An electromagnetic fuel injection valve according to claim 1, wherein the metallic cylindrical-shaped vessel is made of a non-magnetic material or a weak magnetic material wholly or partially in the vicinity of a magnetic path formed by the electromagnetic drive mechanism, or subjected to a processing of non-magnetization or weak magnetization.

7. A method of assembling an electromagnetic fuel injection valve, comprising:

mounting a stationary core, which is provided centrally thereof with a through-hole, into an inner periphery of an end of a metallic cylindrical-shaped vessel and provided at a tip end thereof with a fuel injection port;

thereafter assembling a movable member provided at a tip end thereof with a valve element, which opens and closes the fuel injection port, through the through-hole; and further assembling a spring, which pushes a rear end of the movable member, and a regulator in this order into the through-hole.

8. An electromagnetic fuel injection valve comprising:

a metallic cylindrical-shaped vessel provided at a tip end thereof with a fuel injection port, the other end thereof being closed by a stationary core provided centrally thereof with a through-hole;

a movable member provided at a tip end thereof with a valve element, which opens and closes the fuel injection port, and extending to the fuel injection port from the stationary core; and an electromagnetic drive mechanism that reciprocates the movable member;

the electromagnetic drive mechanism comprising an anchor facing an axial end face of the stationary core to reciprocatingly cooperate with the stationary core;

the anchor is at a center thereof provided with a through-hole into which the movable member is inserted for a relative displacement;

the movable member comprises an engagement portion that engages with an axial engagement surface of the anchor on a side of the stationary core around the through-hole; and a maximum outside diameter of a portion of the movable member between the engagement portion and the valve element is smaller than a minimum inside diameter of the through-hole of the anchor;

wherein a maximum outside diameter of a portion of the movable member between the arrangement portion and is smaller than a minimum inside diameter of the through-hole.

9. A method of assembling the electromagnetic fuel injection valve according to claim 8, wherein after the stationary core is mounted to the metallic cylindrical-shaped vessel, the movable member is assembled through the through-hole, and a spring and a regulator are assembled in this order to the through-hole above the movable member.

10. An electromagnetic fuel injection valve comprising:

a metallic cylindrical-shaped vessel including a small-diameter cylindrical-shaped portion at one end thereof and a large-diameter cylindrical-shaped portion at the other end thereof;

a fuel injection port provided at a tip end of the small-diameter cylindrical-shaped portion;

a stationary core fixed to an interior of the large-diameter cylindrical-shaped portion;

an electromagnetic drive mechanism comprising an electromagnetic coil device provided on an outer periphery of the large-diameter cylindrical-shaped portion and an anchor spring-loaded in a direction away from the stationary core and attracted by the stationary core upon energization of the electromagnetic coil device;

a movable member accommodated between the stationary core and the fuel injection port and arranged to be caused by movements of the anchor of the electromagnetic drive mechanism to reciprocate between the stationary core and the fuel injection port; and a valve element provided at a tip end of the movable member to open and close the fuel injection port;

wherein the anchor faces an axial end face of the stationary core to reciprocatingly cooperate with the stationary core which has a through-hole and has a central through-hole into which the movable member is inserted for a relative displacement, the movable member having an engagement portion that engages with an axial engagement surface of the anchor on a side of the stationary core around the through-hole of the stationary core, a maximum outside diameter of a portion of the movable member between the engagement portion and the valve element being smaller than a minimum inside diameters of the anchor and stationary core through-holes;

the movable member is inserted through the through-hole to extend to the fuel injection port, and a head thereof is inserted through a through-hole provided on the stationary core, and a maximum outside diameter of the head is larger than a minimum inside diameter of the through-hole provided on the anchor and smaller than a minimum inside diameter of the through-hole provided on the stationary core.

11. An electromagnetic fuel injection valve according to claim 10, wherein the electromagnetic coil device comprises:

a cup-shaped yoke fixed to an outer periphery of the large-diameter cylindrical-shaped portion of the metallic cylindrical-shaped vessel;

an annular-shaped coil provided between the outer periphery of the large-diameter cylindrical-shaped portion of the metallic cylindrical-shaped vessel and an inner periphery of the cup-shaped yoke; and an annular yoke that closes an opened end side of the cup-shaped yoke.

12. An electromagnetic fuel injection valve according to claim 10, wherein the stationary core is formed on an outer periphery thereof with an annular flange, and one side end surface of the flange and an end surface of the large-diameter cylindrical-shaped portion of the metallic cylindrical-shaped vessel abut against each other to be fixed together.

13. An electromagnetic fuel injection valve according to claim 10, wherein the stationary core is formed on an outer periphery thereof with an annular flange, and one side end surface of the flange and an end surface of the large-diameter cylindrical-shaped portion of the metallic cylindrical-shaped vessel face or abut against each other to be fixed together, and one side end surface of the annular yoke is positioned so as to be made flush with the other side end surface of the flange of the stationary core and fixed to an outer periphery of the flange.

14. An electromagnetic fuel injection valve according to claim 10, wherein the metallic cylindrical-shaped vessel is formed as an integral body from the same member, and the large-diameter cylindrical-shaped portion is smaller in wall thickness than the small-diameter cylindrical-shaped portion, the small-diameter cylindrical-shaped portion is formed integrally at a tip end thereof with a portion, which is larger in wall thickness than the remaining portions, and the portion having a large wall thickness is formed on an outer periphery thereof with a groove, to which a sealing member is mounted.

15. An electromagnetic fuel injection valve according to claim 10, wherein the metallic cylindrical-shaped vessel is formed as an integral body from the same member, the small-diameter cylindrical-shaped portion is formed integrally at a foremost tip end thereof with a cylindrical-shaped portion, which is smaller in wall thickness than any portion of the metallic cylindrical-shaped vessel, and a guide element including a guide hole, by which a tip end of the movable member is guided, and an orifice plate provided with the fuel injection port are assembled in this order to the cylindrical-shaped portion.

16. An electromagnetic fuel injection valve according to claim 10, wherein the large-diameter cylindrical-shaped portion of the metallic cylindrical-shaped vessel includes an annular groove on an outer periphery of a portion thereof, about which the stationary core and the anchor face each other.

17. An electromagnetic fuel injection valve according to claim 10, wherein an outer periphery of the stationary core is formed to be cylindrical-shaped to be fixed to an inner periphery of the large-diameter cylindrical-shaped portion of the metallic cylindrical-shaped vessel, the stationary core has an end surface on the another side thereof operate the end surface facing the anchor with a projecting cylindrical-shaped portion having a smaller outside diameter than an inside diameter of the large-diameter cylindrical-shaped portion of the metallic cylindrical-shaped vessel, a fuel passage is formed on a center of the stationary core that includes the projecting cylindrical-shaped portion, and a first spring, which applies to the movable member a preload in a direction, in which the fuel injection port is closed, and a regulator, which regulates the preload, are mounted in the fuel passage.

18. An electromagnetic fuel injection valve according to claim 17, further comprising a fuel introduction pipe fixed to an outer periphery of the projecting cylindrical-shaped portion, and a resin compact that covers an end surface of the large-diameter cylindrical-shaped portion of the metallic cylindrical-shaped vessel, an axial end surface of the electromagnetic coil device, an axial end surface of the stationary core, the projecting cylindrical-shaped portion, and a periphery of the fuel introduction pipe and molds therein an electric terminal of the electromagnetic coil device.

19. An electromagnetic fuel injection valve according to claim 18, wherein the projecting cylindrical-shaped portion is formed on an outer periphery thereof with a flange, which bears the axial end surface of the fuel introduction pipe, and the flange is larger in outside diameter than the projecting cylindrical-shaped portion and the fuel introduction pipe.

20. An electromagnetic fuel injection valve according to claim 17, wherein the movable member includes a plunger that couples the head and the valve element, the head of the movable member reciprocates in a through-hole provided on the stationary core and is spring-loaded by the first spring, the anchor is born by an end of a second spring, the other end of which is held by the metallic cylindrical-shaped vessel, and arranged around the plunger to be reciprocatible, and the anchor is interposed between the head of the movable member spring-loaded by the first spring and the second spring to cooperate with the movable member in axial movement.

21. An electromagnetic fuel injection valve according to claim 20, further comprising a plunger guide, an outer periphery of which is press fitted into an inner periphery of the large-diameter cylindrical-shaped portion of the metallic cylindrical-shaped vessel, and which is formed centrally thereof with a guide hole, by which an outer periphery of the plunger is guided, and wherein the plunger guide holds an end of the second spring.

22. An electromagnetic fuel injection valve according to claim 21, further comprising a drawn portion on that outer periphery of the large-diameter cylindrical-shaped portion of the metallic cylindrical-shaped vessel, which corresponds to a press-fitted position of the plunger guide.

23. An electromagnetic fuel injection valve according to claim 20, wherein the valve element formed from a separate member is fixed to a tip end of the plunger.

24. An electromagnetic fuel injection valve according to claim 23, wherein the plunger is formed from a hollow member.

25. An electromagnetic fuel injection valve according to claim 20, wherein the head, the plunger, and the valve element are formed from the same member.

26. An electromagnetic fuel injection valve according to claim 20, wherein the head is formed from a member separate from the plunger and fixed to the plunger.

27. An electromagnetic fuel injection valve according to claim 10, wherein a nozzle body formed as a separate body is mounted to the small-diameter cylindrical-shaped portion of the metallic cylindrical-shaped vessel, the nozzle body is provided on one end side thereof with an insertion cylindrical-shaped portion, which is inserted into an inner periphery of the small-diameter cylindrical-shaped portion of the metallic cylindrical-shaped vessel, and is provided on the other end side thereof with a tip end cylindrical-shaped portion, to which a guide element including a guide hole, by which a tip end of the movable member is guided, and an orifice plate provided with the fuel injection port are assembled in this order.

28. An electromagnetic fuel injection valve according to claim 27, wherein the nozzle body includes an annular groove permitting a sealing member to be mounted to an outer periphery thereof between the insertion cylindrical-shaped portion and the tip end cylindrical-shaped portion.

29. An electromagnetic fuel injection valve according to claim 28, wherein a portion of the nozzle body except the insertion cylindrical-shaped portion, the tip end cylindrical-shaped portion, and the annular groove is larger in wall thickness than both the large-diameter cylindrical-shaped portion and the small-diameter cylindrical-shaped portion of the metallic cylindrical-shaped vessel.

30. An electromagnetic fuel injection valve according to claim 10, wherein an end surface of the large-diameter cylindrical-shaped portion, an axial end surface of the electromagnetic coil device, and an axial end surface of the stationary core are positioned on the same plane.

31. An electromagnetic fuel injection valve comprising:

an electromagnetic drive mechanism comprising an anchor caused by an electromagnetic force generated by an electromagnetic coil device to cooperate with a stationary core to reciprocate; and a movable member caused by movement of the anchor to reciprocate between the stationary core and a fuel injection port, and the fuel injection port is opened and closed by a valve element provided at a tip end of the movable member, wherein the anchor faces an axial end face of the stationary core to reciprocatingly cooperate with the stationary core and is at a center thereof provided with a through-hole into which the movable member is inserted for a relative displacement, and the movable member has an engagement portion that engages with an axial engagement surface of the anchor on a side of the stationary core around the through-hole, and a maximum outside diameter of a portion of the movable member between the engagement portion and the valve element being smaller than a minimum inside diameter of the through-hole of the anchor; and a metallic cylindrical-shaped vessel including a large-diameter cylindrical-shaped portion having the stationary core fixed to an interior thereof and having the electromagnetic coil device mounted to an outer periphery thereof, and a small-diameter cylindrical-shaped portion provided at a tip end thereof with the fuel injection port.

32. An electromagnetic fuel injection valve according to claim 31, wherein the large-diameter cylindrical-shaped portion and the small-diameter cylindrical-shaped portion of the metallic cylindrical-shaped vessel are formed as a part of an integral body from the same member, and the large-diameter cylindrical-shaped portion is smaller in wall thickness than the small-diameter cylindrical-shaped portion, the small-diameter cylindrical-shaped portion is formed integrally at a tip end thereof with a portion, which is larger in wall thickness than the remaining portions, and the small-diameter cylindrical-shaped portion is formed integrally at a foremost tip end thereof with a cylindrical-shaped portion, which is smaller in wall thickness than any portion of the metallic cylindrical-shaped vessel, and a guide element including a guide hole, by which a tip end of the movable member is guided, and an orifice plate provided with the fuel injection port are assembled in this order to the cylindrical-shaped portion.

33. An electromagnetic fuel injection valve according to claim 32, wherein the portion having a large wall thickness is formed on an outer periphery thereof with a groove, which permits a sealing member to be mounted.

34. An electromagnetic fuel injection valve according to claim 31, wherein the large-diameter cylindrical-shaped portion of the metallic cylindrical-shaped vessel includes an annular groove on an outer periphery of a portion thereof, about which the stationary core and the anchor face each other.

35. A method of assembling the electromagnetic fuel injection valve according to claim 31, the method comprising the steps of:

forming a fuel injection port on an end of a metallic cylindrical-shaped vessel provided on one side thereof with a small-diameter cylindrical-shaped portion and on the other side thereof with a large-diameter cylindrical-shaped portion, mounting a combination of a stationary core and an anchor in the large-diameter cylindrical-shaped portion, fixing an electromagnetic coil device to an outer periphery of the large-diameter cylindrical-shaped portion, molding an electric terminal of the electromagnetic coil device and a part of the stationary core with a resin, assembling a movable member though though-holes of the stationary core and the anchor, and regulating the movable member in stroke.

* * * * *